US008333151B2

(12) United States Patent
Krisher

(10) Patent No.: US 8,333,151 B2
(45) Date of Patent: Dec. 18, 2012

(54) APPARATUS AND METHOD FOR SPLITTING AND REMOVING A SHROUD FROM AN AIRBORNE VEHICLE

(75) Inventor: Ehud Krisher, Haifa (IL)

(73) Assignee: Rafael Advanced Defense Systems, Ltd., Haifa (IL)

( * ) Notice: Subject to any disclaimer, the term of this patent is extended or adjusted under 35 U.S.C. 154(b) by 0 days.

(21) Appl. No.: 12/864,847

(22) PCT Filed: Jan. 28, 2009

(86) PCT No.: PCT/IL2009/000106

§ 371 (c)(1),
(2), (4) Date: Nov. 1, 2010

(87) PCT Pub. No.: WO2009/095910

PCT Pub. Date: Aug. 6, 2009

(65) Prior Publication Data

US 2011/0036261 A1 Feb. 17, 2011

(30) Foreign Application Priority Data

Jan. 28, 2008 (IL) ..... 189089

(51) Int. Cl.

| | |
|---|---|
| ***F42B 15/36*** | (2006.01) |
| ***B01J 7/00*** | (2006.01) |
| ***F42C 15/00*** | (2006.01) |

(52) U.S. Cl. ..... 102/378

(58) Field of Classification Search ..... 102/377, 102/378

See application file for complete search history.

(56) References Cited

U.S. PATENT DOCUMENTS

| | | | | |
|---|---|---|---|---|
| 4,372,212 | A * | 2/1983 | Hoelzen et al. | 102/264 |
| 6,575,097 | B1 | 6/2003 | Nodarse | |
| 6,679,453 | B2 * | 1/2004 | Steiner | 244/121 |
| 7,082,878 | B2 | 8/2006 | Facciano | |
| 2007/0074636 | A1 * | 4/2007 | Rieger et al. | 102/378 |

* cited by examiner

*Primary Examiner* — Bret Hayes
(74) *Attorney, Agent, or Firm* — Rodney J. Fuller; Booth Udall, PLC

(57) ABSTRACT

The present invention relates to an apparatus for splitting and removing a shroud from an airborne vehicle, that comprises a shroud that includes two components, linkable one to another along their lengths, and wherein upon being fastened one to the other, they form a shroud with a lengthwise axis and an inner space, and having a base sector around the circumference of the bottom part of said shroud, and wherein said base is connectable to said airborne body and a fastening assembly for fastening said two components of said shroud one to the other, and wherein said fastening assembly is given to be torn on stretching upon detonation of a pyrotechnic charge and a piston assembly that disassembled at the completion of the piston's stroke, and is operable by said pyrotechnic charge, and wherein said piston assembly serves for timed tearing of said fastening assembly.

22 Claims, 15 Drawing Sheets

Figure 1A:
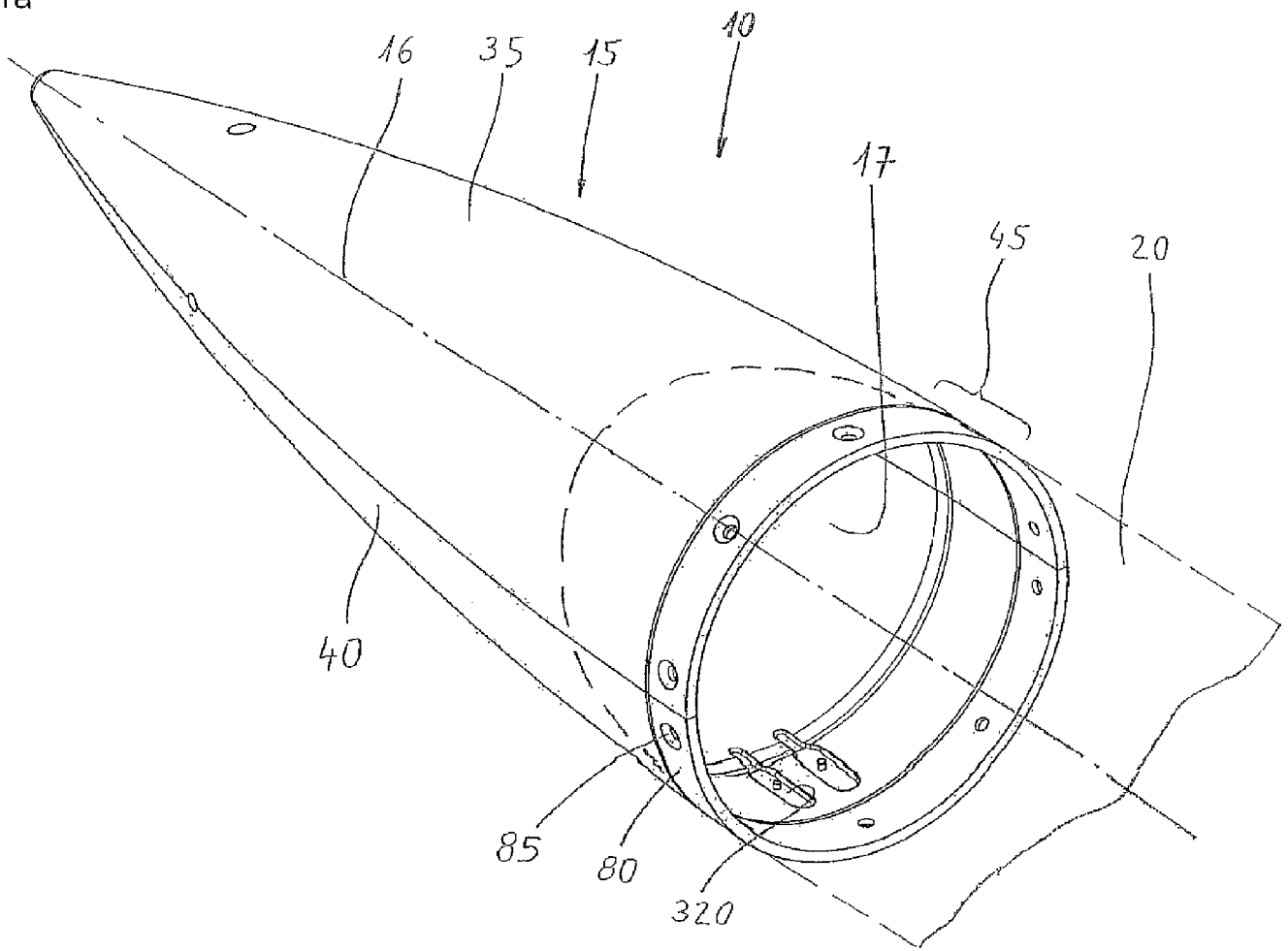

APPARATUS AND METHOD FOR SPLITTING AND REMOVING A SHROUD FROM AN AIRBORNE VEHICLE

RELATED APPLICATION DATA

This application is the U.S. national stage of PCT/IL2009/000106, filed Jan. 28, 2009, which claims the benefit of Israeli Patent Application No. 189089, filed Jan. 28, 2008, the contents of each of which are herein incorporated by reference for all purposes.

FIELD OF THE INVENTION

The present invention, subject matter of this patent application, belongs to the field of apparatuses intended to split and remove a shroud (cover) from an airborne vehicle in general and for splitting and removing, for example—the nose cone of a missile in particular.

BACKGROUND OF THE INVENTION

In airborne vehicles, such as missiles or unmanned airborne vehicles ("UAV's") there are sometimes installed payloads, homing heads or sensors whose exterior configuration or form disrupts the aero dynamic efficiency of the airborne vehicle.

For example—

A missile that is launched from the ground to intercept an airborne target (for example—a rocket launched by the enemy, or an enemy plane), might be based on an existing air to air missile. At the nose of such a missile, an optical homing head is mounted, endowed with a dome shaped configuration on its front end (for example—a dome shaped optical window of a sensor that is scanning in search of heat (IR) radiated by the target).

From the aero dynamical aspect—a dome shaped configuration at the nose of a flying body is not efficient, in comparison to a conical or an ogival one. When launching from the ground (or from a mobile platform—vehicle, boat and the like), the launching takes place—practically, at zero speed, and the launched missile has the task to accelerate quickly towards the approaching threat. Under these circumstances the dome shaped configuration of the missile's nose, and its impaired efficiency, as said, from the aero dynamic point of view, constitutes an additional limitation on the ability of the missile to accelerate at the required rate. This, wherein actually, at the earlier stages of the launch and acceleration of the missile in the general direction of the target which has to be intercepted, there exists no real need in these stages to operate the optical homing head (that has the dome shaped configuration and is installed at the front end of the missile). In other words, the aero dynamic limitation stems from the existence of a means that is not being used in the early stages.

Additional missile applications that required delaying the exposure of the missile's homing head are those missiles that are designed as relatively low cost interceptors, in which the budgeting constrains dictate the use of relatively low cost materials, for example—manufacturing the optical dome of the missile homing head from a materials that cannot sustain high temperatures for extended periods of time (in comparison to the highly expensive sapphire type of material as used in advanced air to air missile domes). Therefore in an operational scenario, wherein a low cost ground to air interceptor is desired, the high acceleration constrains dictate either the use of a combination of an acceleration stage with a dome type missile wherein the dome is manufactured from high thermal performance and expensive materials utilizing low cost materials but delaying the exposure of the missile dome while accelerating to the sky.

Hence, in the recent years, devices were developed that split and remove the shroud of the nose cone from an airborne vehicle, in a manner that enables to install in the airborne vehicle (for example, at the head of the ground to air missile cited above), a shroud that is efficient from the aero dynamic aspect, and wherein splitting and removing of that shroud, while exposing the homing head or sensor with the dome shaped configuration at the front end (in accordance with the example that we cited above), only at a later flying stage and when verily its activation is required. Such a removable nose cone prevents over heating of the homing dome, prevents unnecessary use of an accelerator stage, enables manufacturing of the dome from relatively low cost materials, while at the same time, contributes to the achievement of preferable envelope of performance by the missile in terms of maneuverability, angle of attack, sideslip and acceleration.

Thus for example—

A patent application that was published in the USA numbered US 2007/0074636 describes a "jettisonable nose cone and missile with a jettisonable nose cone". The above cited patent application describes a pyrotechnical device that is characterized by that that it comprises a connecting pin that serves for attaching and fastening the two parts of the nose cone one to the other. Inside the connecting pin, there is integrated the pyrotechnical charge. Detonating the pyrotechnical charge results in breaking the connection pin (inside which, as said, the charge is embedded), and the formation of gas pressure that leads to the splitting and removing of the two parts of the nose cone one from the other.

The device that is described in the above cited patent application is ridden by several disadvantages—

The configuration of the device is illustrated there in FIG. 3, and is based on threads as the connecting and sealing means (see ibid, threads numbered 70 and 71) in a manner that might induce sealing problems and failure resulting from possible leak of gas from the instant the pyrotechnical charge is detonated. This, and more: the configuration of the device that relies on nuts for the task of positioning and fastening (see ibid, devices numbered 26 and 29), dictates the need for the existence of relatively large access openings, formed in the nose cone, that inherently disrupts the aerodynamic continuity of the shroud and disrupts the aero dynamics efficiency of the nose cone.

The configuration of the device that is illustrated there in FIG. 7 might be susceptible as well to several setbacks such as sealing problems and failure due to gas leaks when detonating the pyrotechnic charge, because it relies—as elaborated above, on threads as the connecting and sealing assuring means. This configuration, as used earlier, mandates that relatively large access openings would e formed in the nose cone, thus disrupting the aerodynamic continuity of the surface areas of the shroud.

Moreover—

In this configuration, on detonating the pyrotechnic charge and the separation of the two parts of the nose cone, while moving farther away one from the other, in an essentially circular movement of one from the other, phenomena of clamping may take place. The clamping may take place between the two cylindrical components (see ibid, components 54 and 55), that—upon assembling the nose cone become interlaced one in the other, and this despite of detonation of the pyrotechnic charge and the breaking of the connection element (the pin that in accordance with the technology that is described in the above cited patent application, serves both for connecting and fastening the two parts of the nose cone one to the other and—as well, as the bracket for the pyrotechnic charge that is included in it).

An additional deficiency that might be found in the configuration of the above cited device, constitutes the limitation due to lack of symmetry that is instilled on the structure of the nose cone (as a consequence from the characteristics of the two cylindrical components interlaced in it, one inside the other), which requires separate manufacturing of different components (and increases the costs). Additional deficiencies that might be found in the design illustrated in FIG. 7 (ibid) of said patent application, is its clumsy (and accordingly heavy) structure that might also require a metal structure of the cylindrical components and their bases—because of the impeding danger of forming fractures and fragments upon detonation of the pyrotechnic charge.

The two configurations described in the above cited patent application, even require dedicated tools for the work, e. g. for assembling the components of the various devices (see for example the usage made with non standard nuts with external threads), and also—

The above mentioned publication does not treat the issue of the safety of the pyrotechnic charge. Detonation of the charge, if it would occur inadvertently, due to a mistake or in consequence of a failure—and this if as long as the missile was not inserted in the canister (provided that we are considering a missile dubbed "missile in a box" type), would lead, directly, to active and very powerful separation of the two parts of the nose cone while endangering the people in the vicinity.

SUMMARY OF THE INVENTION

The invention, the subject matter of this patent application, constitutes an apparatus for splitting and removing a shroud from an airborne vehicle. A novel apparatus that overcomes the deficiencies of lack of sensitivity to proper sealing, disrupting the aerodynamic continuity of the surface areas of the shroud, the danger of clamping and locking of the parts one to the other, the excess weight, proliferation of parts, substantial manufacturing costs and the lack of mechanical assurance to protect the pyrotechnic charge, all the deficiencies that were found to exist in the prior art relating to the present invention.

In one aspect of the present invention, it constitutes an apparatus for splitting and removing a shroud from an airborne vehicle, of the type that includes a shroud that comprises two components linkable one to the other along their lengths, and that upon being fastened one to the other, they form a shroud with a lengthwise axis and an inner space, a shroud that has a base sector defined around the circumference of the bottom part of the shroud and said base is connectable to the airborne vehicle body.

The apparatus also includes a fastening assembly for fastening the two components of the shroud one to the other. The fastening assembly is given to be torn on stretching upon detonation of a pyrotechnic charge.

The apparatus also includes, in addition, a piston assembly that disassembled at the completion of the piston's stroke, and is operable by the pyrotechnic charge. The piston assembly serves for timed tearing of the fastening assembly and to "active" removal of the two components of the shroud one from the other, in an essentially revolving motion and while tearing and moving farther apart the shroud's base from the airborne vehicle body.

A constructional characteristic of an apparatus for splitting and removing a shroud from an airborne vehicle, which is in accordance with the present invention, is the positioning of the fastening assembly that is given to be torn on stretching upon detonation of a pyrotechnic charge, at a distance and separated from the piston assembly. In other words—the piston assembly that is disassembled upon conclusion of the piston's stroke is a separate and autonomous assembly that is not connected nor related to the tightening assembly.

An additional constructional characteristic of the novel apparatus, is that the axes of operation of the two assemblies—the first operating axis is the axis of the fastening assembly that is torn on stretching, and the second operating axis is the axis of the piston assembly that is disassembled on the termination of the piston's stroke—are axes that are essentially parallel one to the other, while essentially orthogonal and radial in their direction of operation relatively to the shroud's lengthwise axis.

In yet an optional and an additional aspect of the present invention, the apparatus for splitting and removing a shroud from an airborne vehicle in accordance with the present invention, might also include an extractable and removal safety means. A safety means that while not extracted and removed from its position, prevents the two components of the shroud from separating and moving apart one from the other, even in case wherein the pyrotechnic charge has been detonated inadvertently or due to a failure.

In yet another different and additional aspect of the present invention, an apparatus in accordance with the present invention for splitting and removing a shroud from an airborne vehicle, embodies in the mode of its operation also a new general method for splitting and removing a shroud from a flying body. This new method is characterized by its attribute of including the stage of pyrotechnically actuating a piston assembly that is disassembled upon completing the piston's stroke, and that is positioned at a distance and separated from a fastening assembly that serves for fastening the two shroud's components one to the other, and wherein the piston's rod movement causes the biasing of the fastening assembly into a stretching stress that brings about its tearing, and wherein the actuating axes of the two assemblies are essentially parallel one to the other, and essentially orthogonal and radial in their direction of operation relatively to the lengthwise axis of the shroud.

In addition to overcoming the deficiencies that are embedded in the prior art exist in this discipline as cited above, an apparatus for splitting and removing a shroud from an airborne vehicle that would be embodied in accordance with the present invention—is durable and would not disrupt the stability of the shroud until issuing the timing command of performing the splitting and removing operation. Actuating the piston assembly and tearing the fastening assembly, do not detract from the integrity of the components of the shroud that become separated one from the other, in their entirety (completeness) and without producing fragment nor superfluous fractures (except tearing the fastening assembly). The step of separation is active enough, in a manner that prevents the parts of the shroud from hitting other components of the airborne vehicle body. The apparatus is given to efficiently operate in a wide "envelope" of performance parameters (in regards to speed, angle of attack or acceleration values of the airborne vehicle). Similar apparatuses under similar operational conditions would provide identical results (repeatability). The apparatus in accordance with the invention conforms to the environmental conditions applying to an airborne vehicle of the relevant type (for example, ground to air missile). The apparatus is also amenable to be manufactured in series production and with relatively a low price.

BRIEF DESCRIPTION OF THE ACCOMPANYING FIGURES

The present invention will be described herein under in conjunction with the accompanying figures. Identical components, wherein some of them are presented in the same figure—or in case that a same component appears in several figures, will carry an identical number.

Figure 1B:
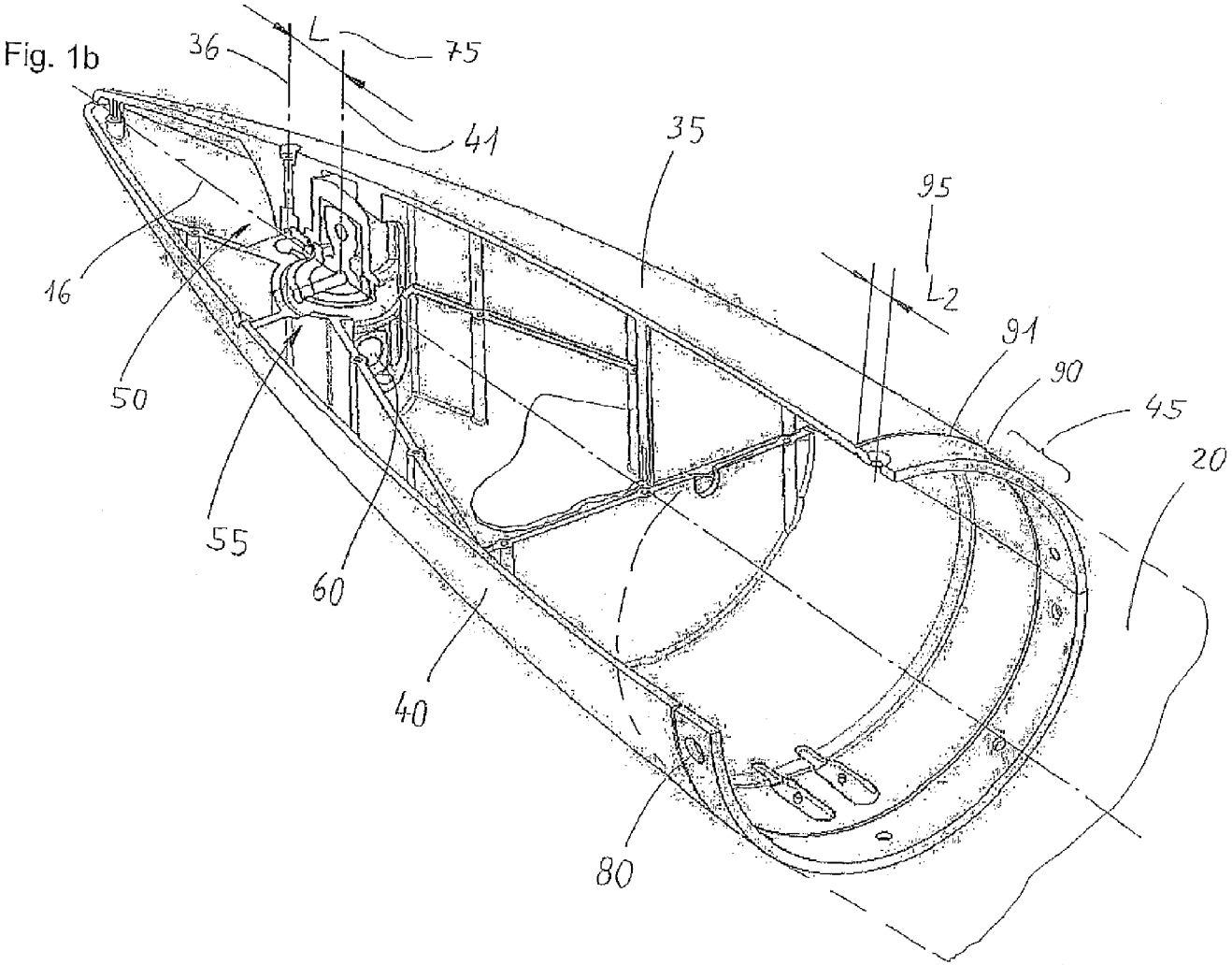
Figure 1C:
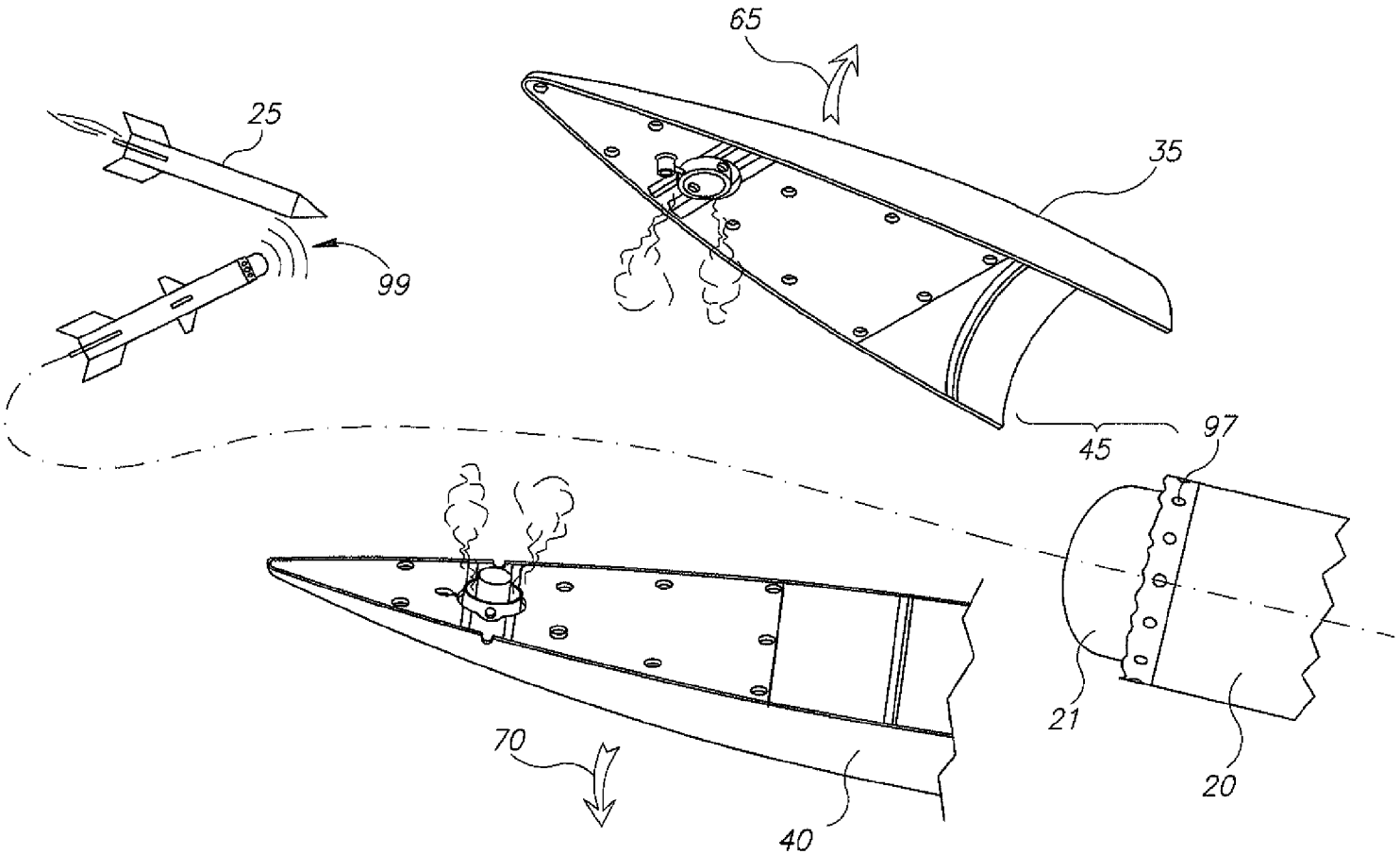

FIGS. 1*a* to 1*c* constitute a sequence of schematic drawings in which there is illustrated an example of the operational mode of an apparatuses in accordance with the present invention, wherein in the illustrated example, reference is made to the activation of the apparatuses for a timed splitting and removing of a shroud off the nose of an airborne vehicle's body, e. g. one such as a ground to air missile, on its course of flying to intercept an attacking rocket.

FIGS. 2*a* to 2*e* constitute exploded view depict various components that serve in the apparatuses whose operational mode was described in FIGS. 1*a* to 1*c*.

Figure 2A:
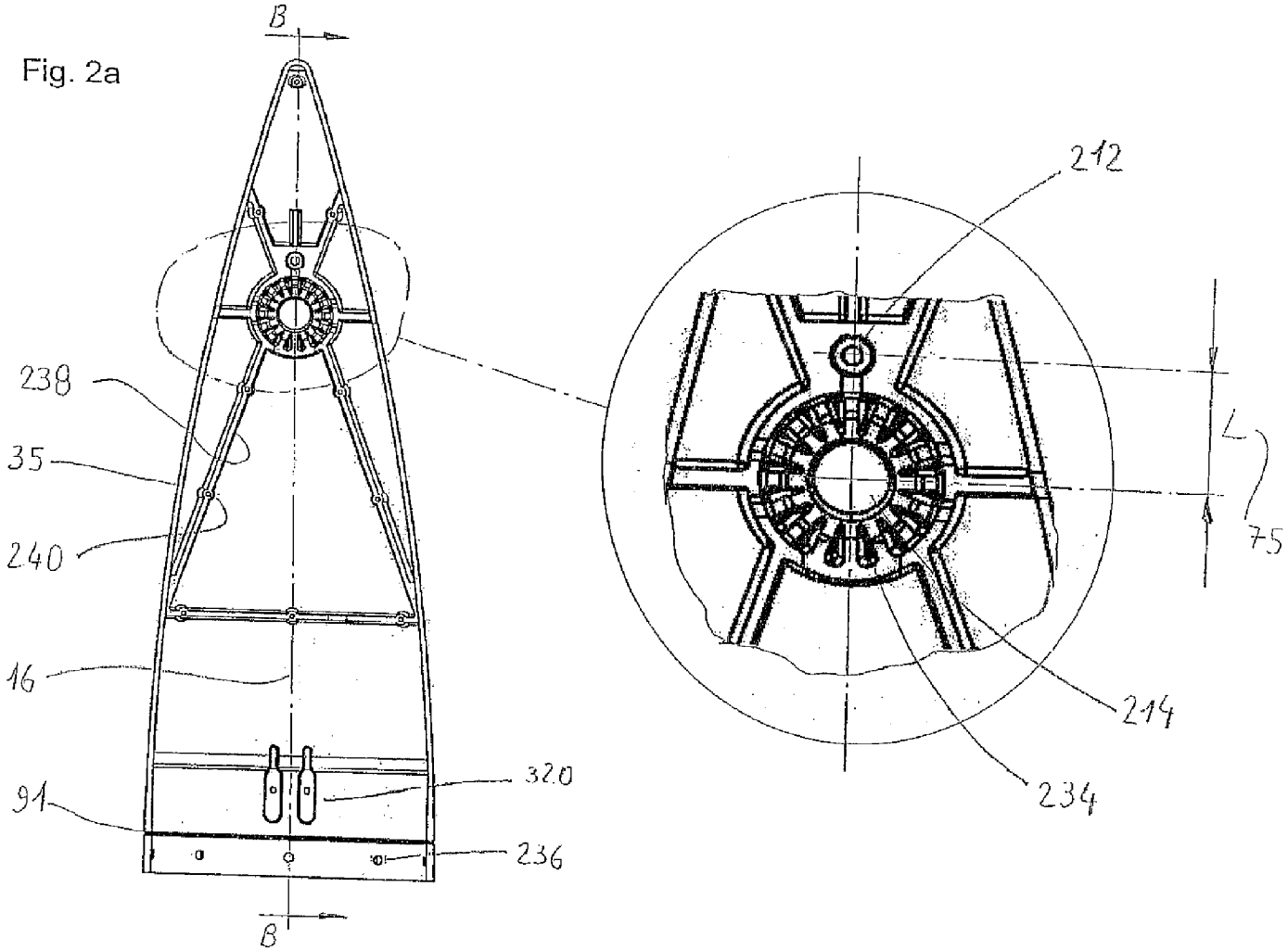
Figure 2B:
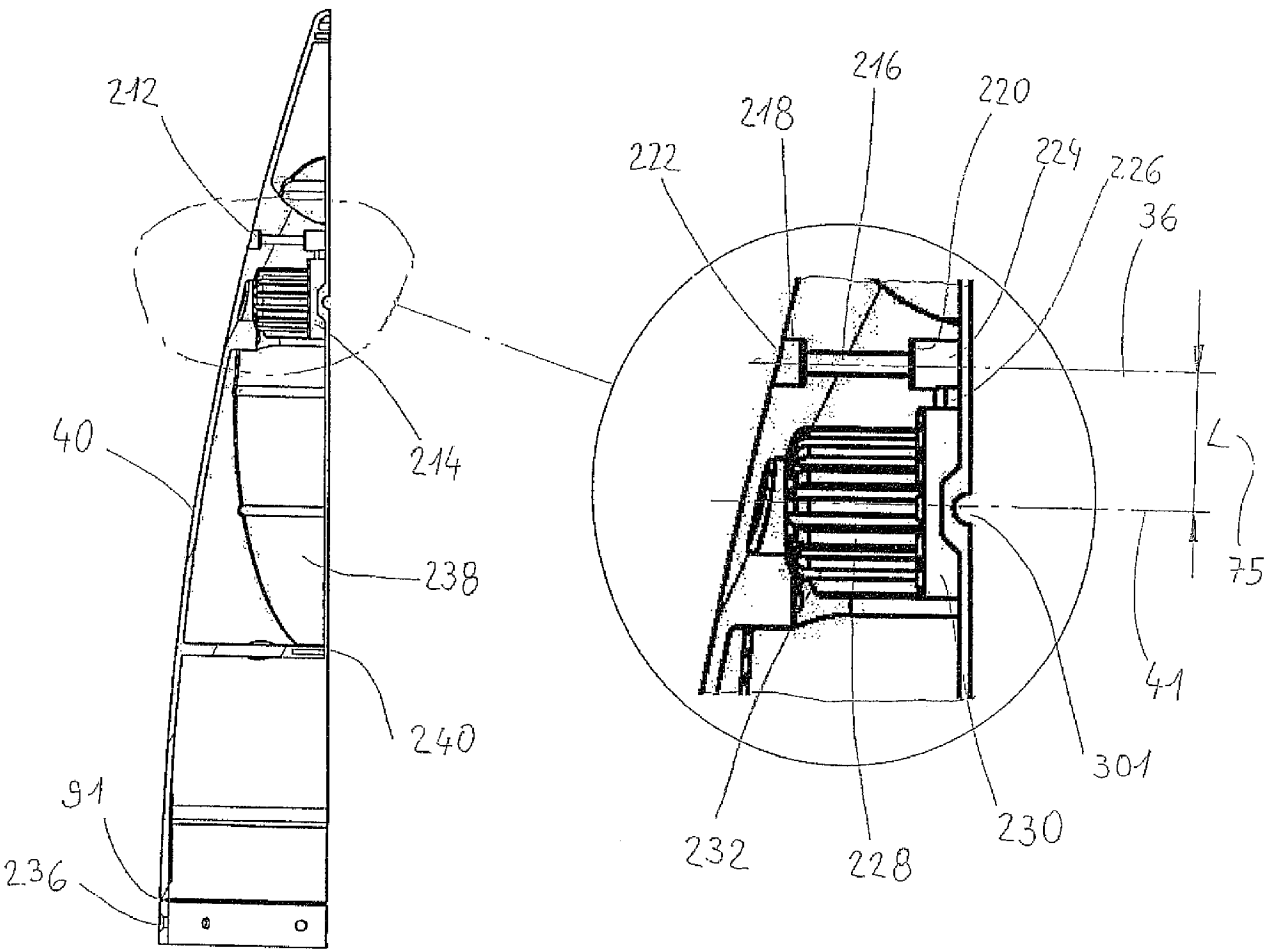
Figure 2C:
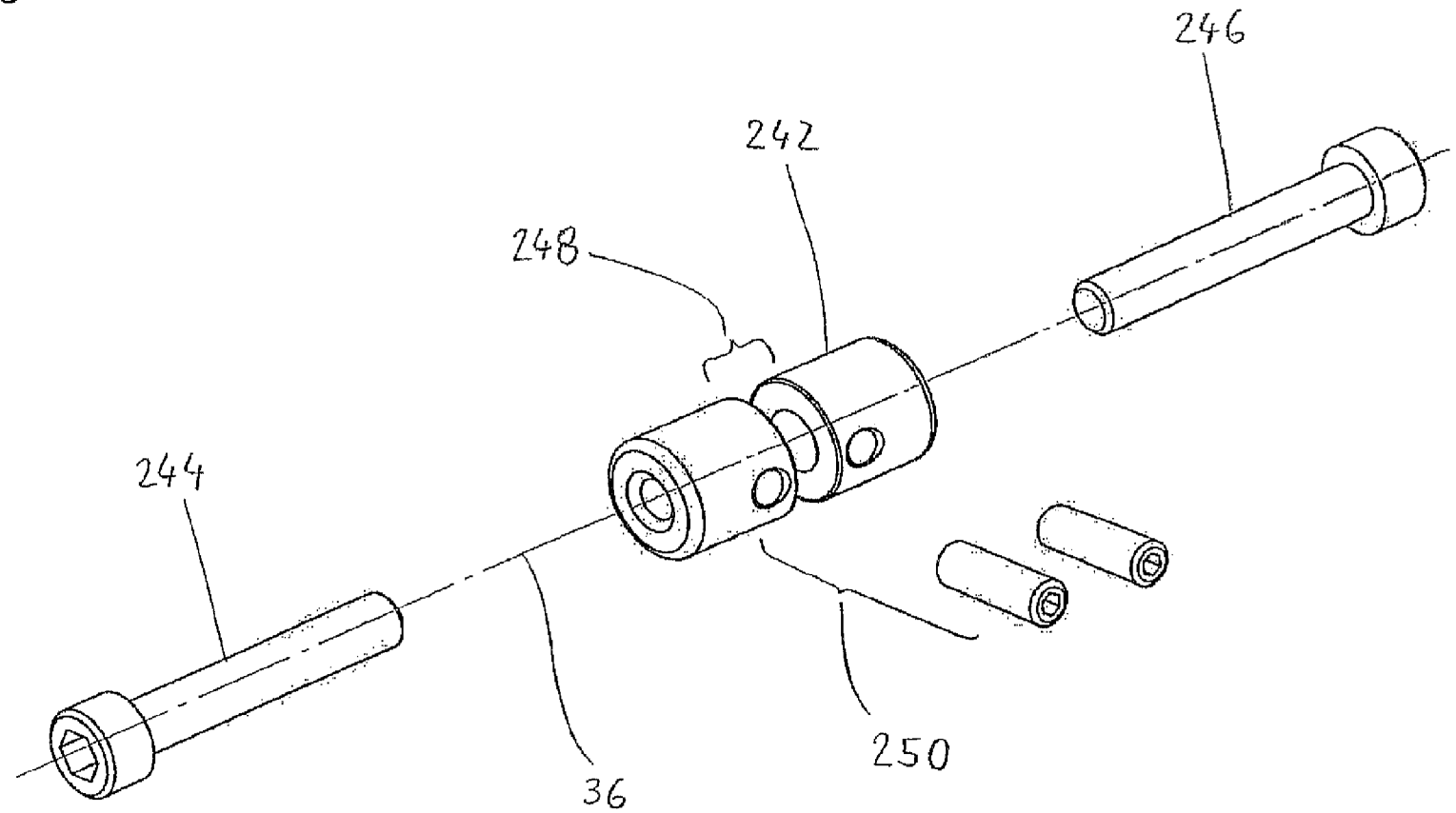
Figure 2D:
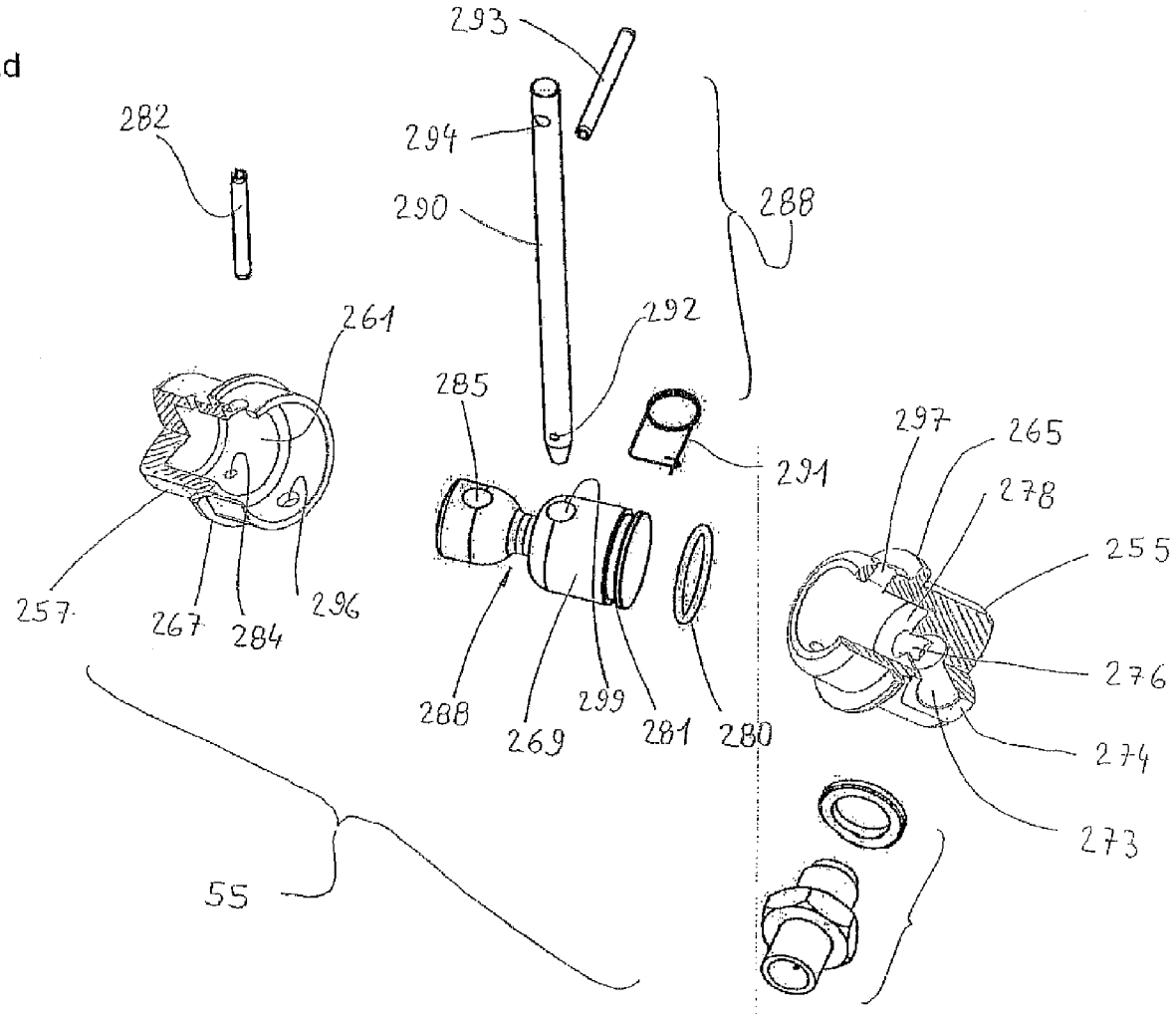
Figure 2E:
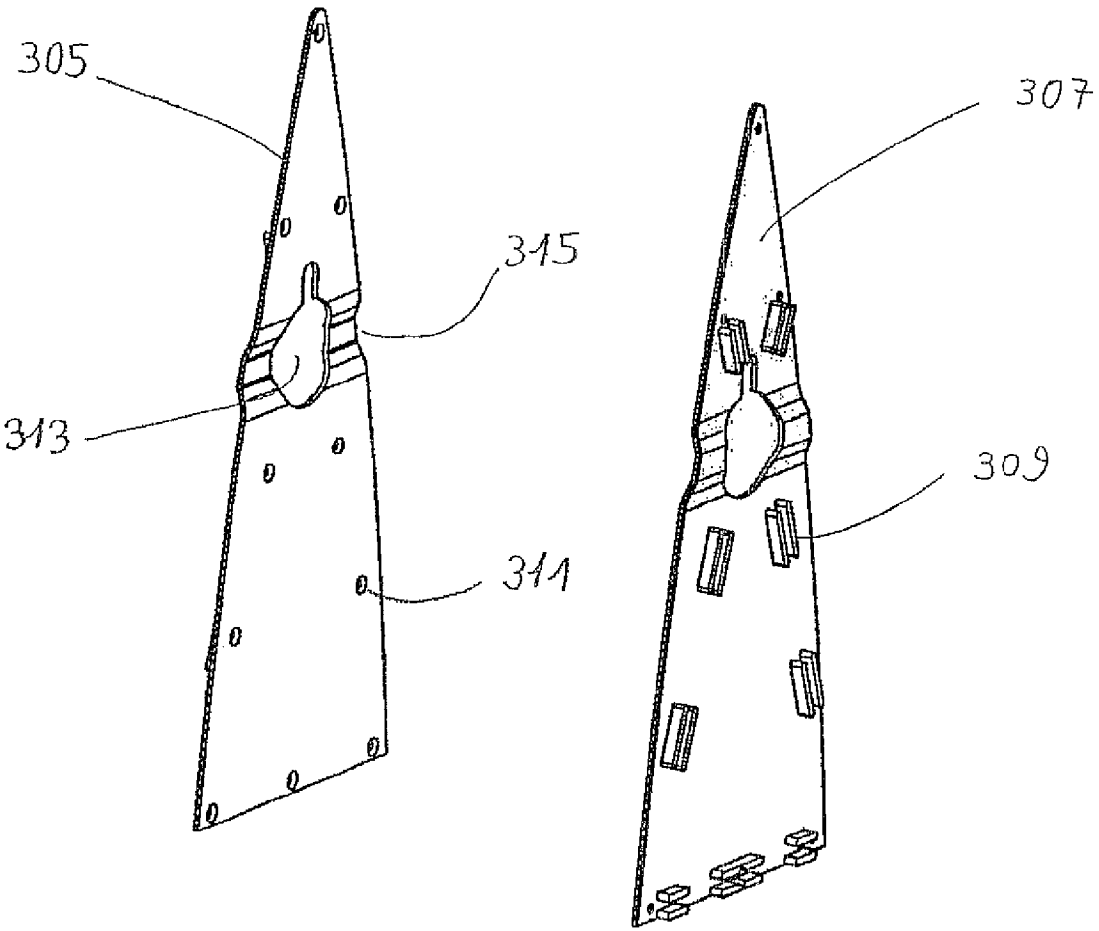
Figure 3A:
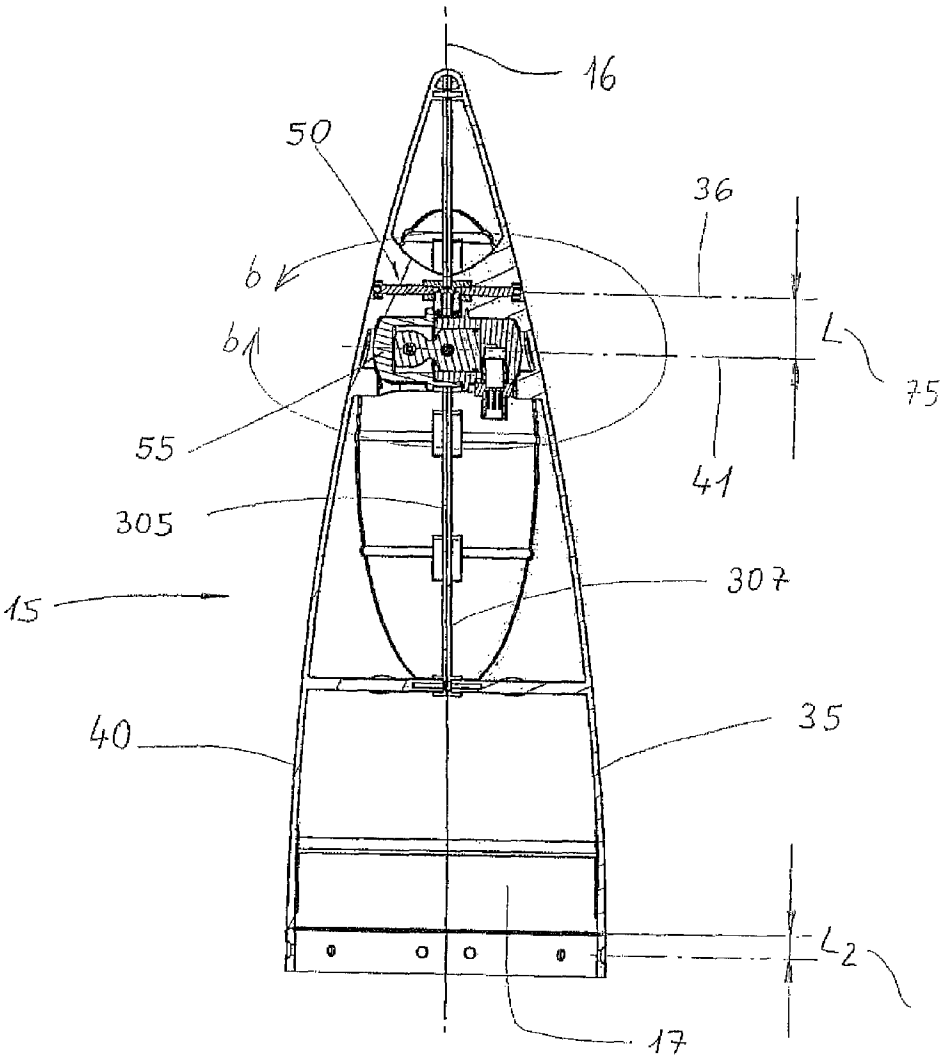
Figure 3B:
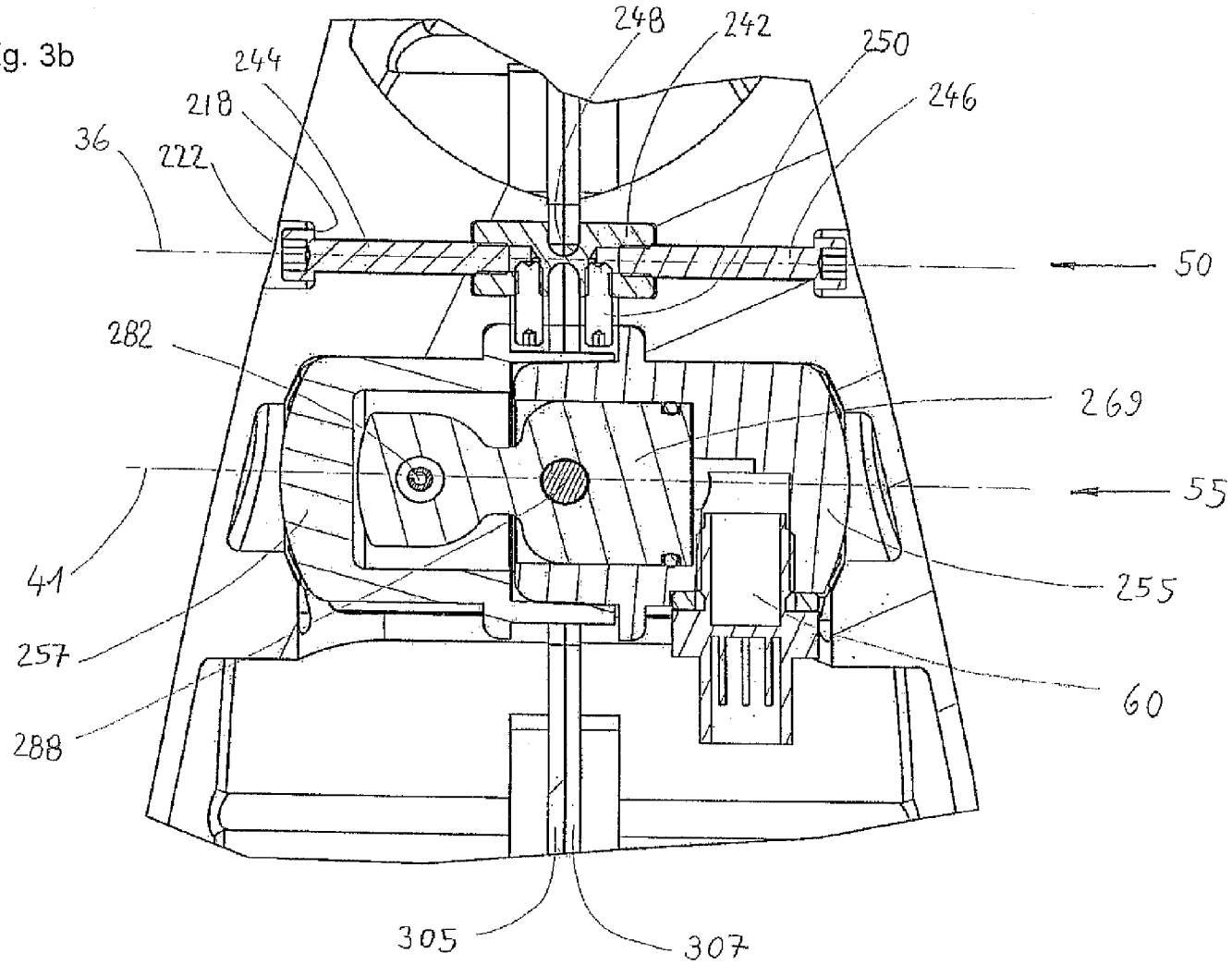

FIGS. 3*a* and 3*b* present by a cross sections, an assembly of the apparatuses whose components are illustrated in FIGS. 2*a* to 2*e*, and an enlarged view of the of the area marked b-b in drawing 3*a*, respectively (the apparatuses is shown in a safety locked position).

Figure 4A:
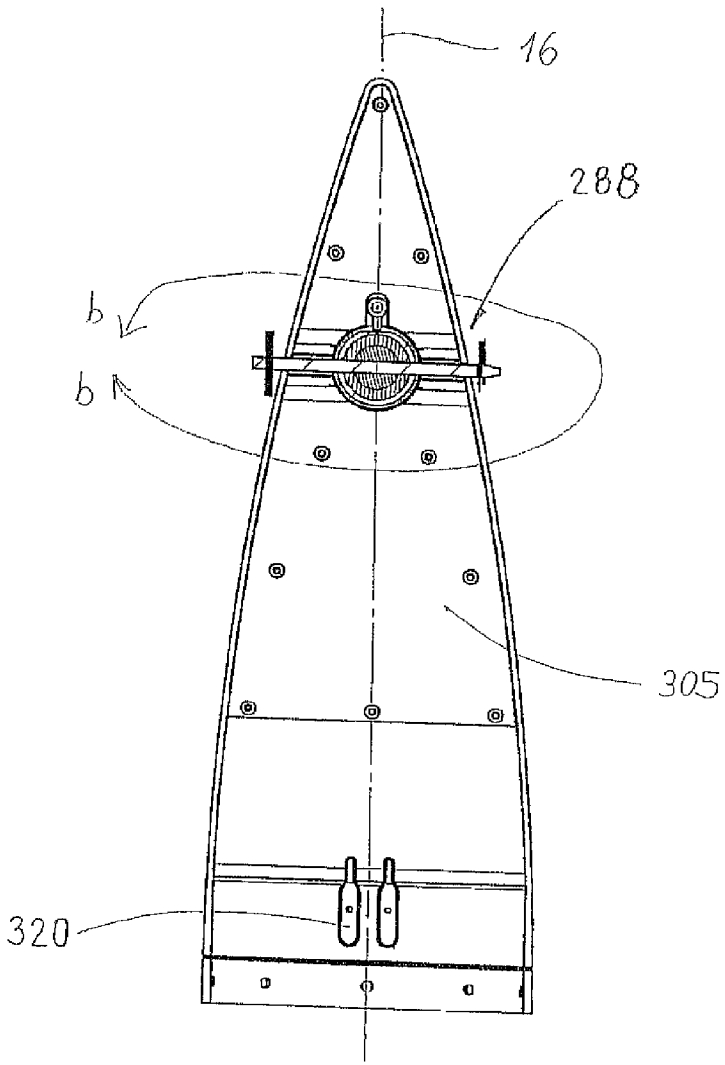
Figure 4B:
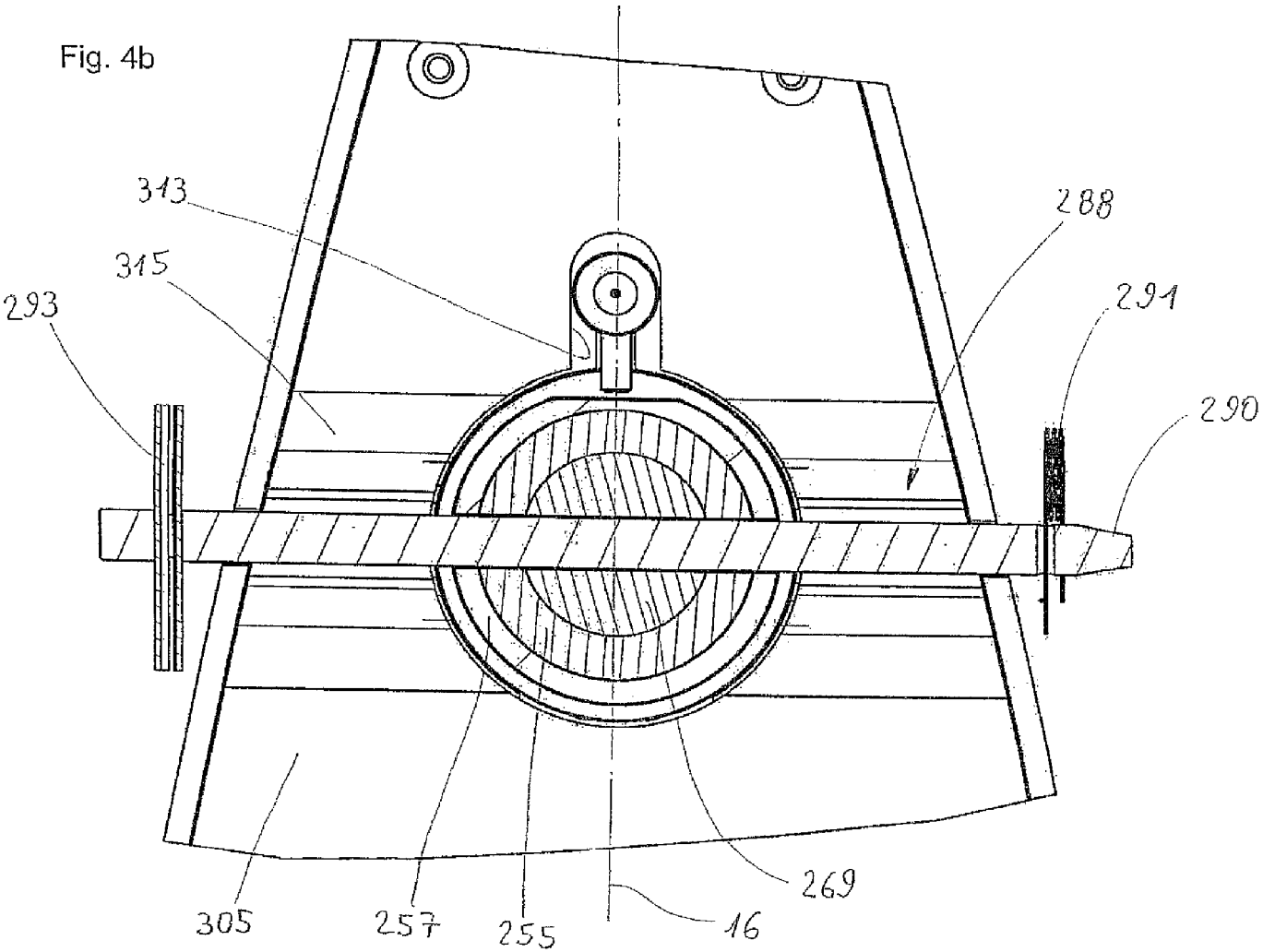

FIGS. 4*a* and 4*b*, similarly to FIGS. 3*a* and 3*b*, also constitute a cross section view of an assembly of the apparatuses whose components are shown by the illustrations of FIGS. 2*a* to 2*e*, but at another angle (a cross section at 90 degrees angle rotation relative to the cross section illustrated in FIG. 3*a*), and an enlarged view of the area marked b-b in drawing 4*a*, respectively (in these figures too, the apparatuses is shown in a safety locked position).

Figure 5A:
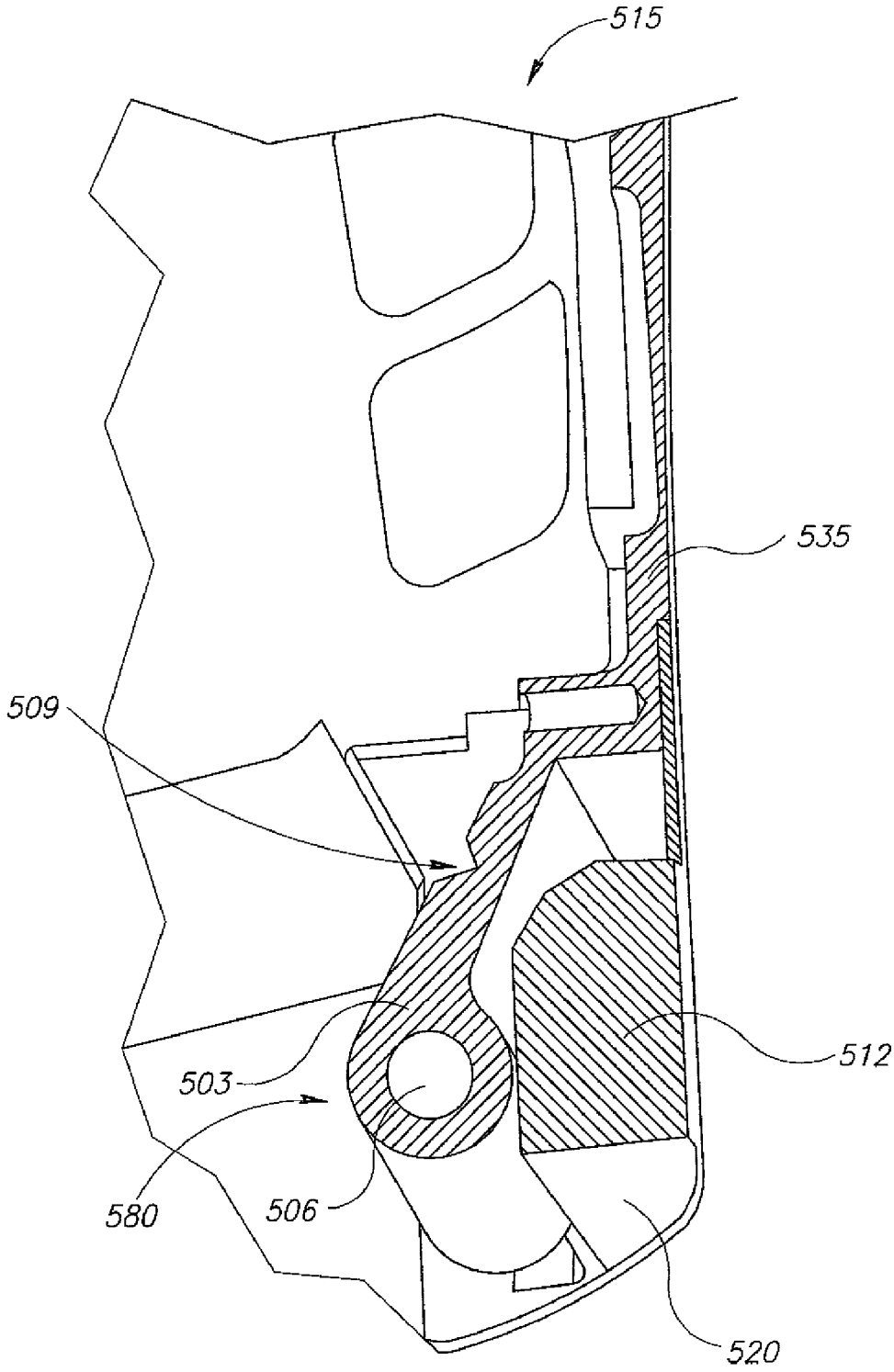
Figure 5B:
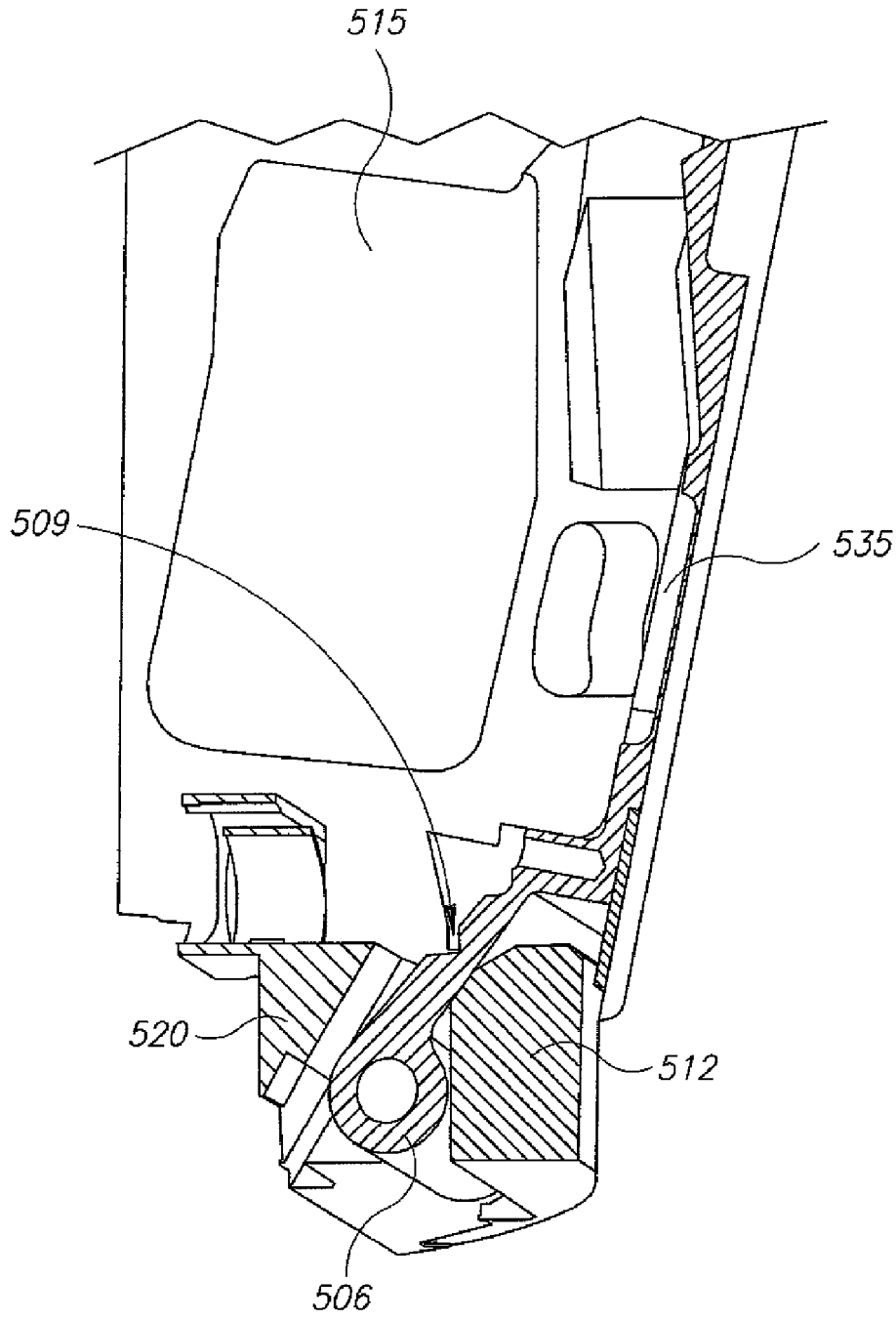
Figure 5C:
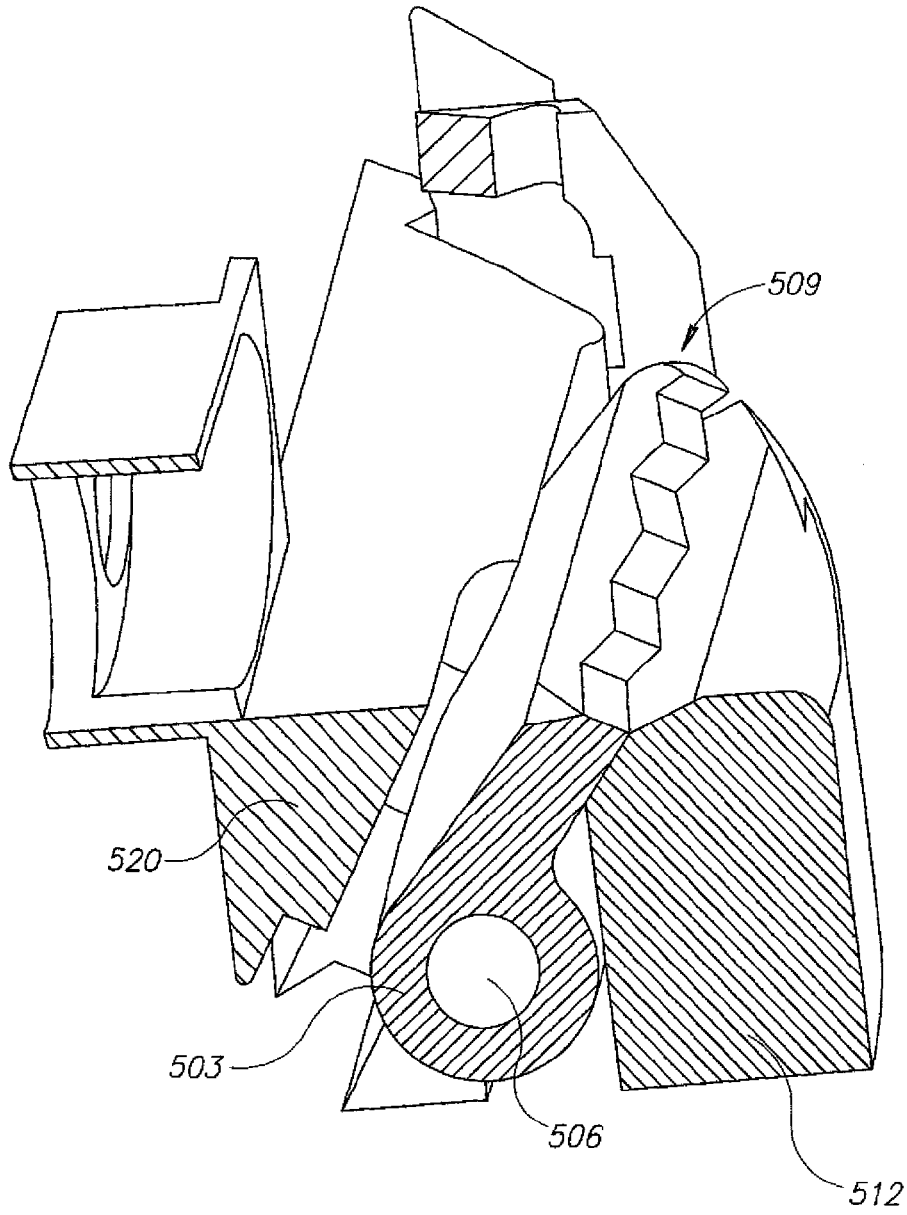

FIGS. 5*a* to 5*c* constitute a sequence of drawings that describe an example of a mechanical mechanism made in order to guide a component of the shroud unto a large opening angle before it would be detached together with presenting the manner of the mechanism's operation.

DETAILED DESCRIPTION OF A PREFERRED EMBODIMENT OF THE PRESENT INVENTION

Reference is being made to FIGS. 1*a* to 1*e*. FIGS. 1*a* to 1*c* constitute a sequence of schematic drawings in which there is illustrated an example of the operational mode of an apparatus 10 in accordance with the present invention. Reference is made to the activation of the apparatus for a timed active splitting and removing of a shroud (cover) 15 off the dome shaped nose of an airborne vehicle e. g. ground to air missile 20 (that solely for drawing convenience only a part of it is illustrated and by a broken (dashed) lines). In the illustrated example, actuation of apparatuses 10 is accomplished in the course of the missile 20 flight towards the target, namely a ground to ground rocket 25 (see FIG. 1*c*).

Any professional experienced in this field would understand that we are considering solely an example, and that an apparatuses in accordance with the present invention might be implemented for splitting and removing other and different shrouds of airborne vehicle (for example—splitting and removing of a nose cone from a homing head of a UAV or splitting and removing a cover off an optical window of a flying electro optical pod).

An apparatus 10 includes a nose cone type of shroud 15 that comprises two identical components, 35 and 40. Components 35 and 40 are indeed attachable flush one to the other along their entire length. On being attached flush one to other as said, they form the nose cone shroud 15 as a body that has a lengthwise axis 16 and a hollow internal space 17. Shroud 15 has a base sector 45 formed around the circumference of the shroud at its bottom part. Base sector 45 is attachable to the top end of ground to air missile 20.

An apparatus 10 comprises in addition a fastening assembly 50 that can be torn by stretching (see FIG. 1*b*). Fastening assembly 50 serves to accomplish a mechanical fastening one to the other of the two components 35 and 40 of nose cone 15.

apparatuses 10 includes in addition a piston assembly 55 that is dismantled after the completion of the piston's stroke, and is operable by a pyrotechnic charge, such as a pressure cartridge or gas generator 60 that consists a part of it. Piston assembly 55 serves to provide a timed tearing of fastening assembly 50 and for "active" removal of the two components 35 and 40 of nose cone 15 one from the other, in an essentially revolving motion (see the directions of the arrows 65 and 70 in FIG. 1*c*) around base 45 that constitutes something like a rotation axis—and while being disengaged from base 45 and from the airborne vehicle (missile 20 in the illustrated example).

In addition, apparatuses 10 is characterized by that that the operation axes of the two assemblies, the first operation axis 36 of fastening assembly 50 that is given to be torn on stretching, and the second operation axis 41 of piston assembly 55 that is disassembled at the conclusion of the piston's stroke, wherein both axes 36 and 41, are essentially parallel one to the other, orthogonal and radial in their directions of operation in relation to the lengthwise axis 16 of the shroud.

Prior to the splitting and removing action the two parts of shroud 15—components 35 and 40—are fastened one to the other in order to withstand the stresses of shearing and stretching unto which they are exposed in the course of the launching and maneuvering of missile 20 and until the instant of giving the separation command.

Already at this stage of the description, and before we switch to presenting a detailed description of the construction of the parts and components of apparatuses 10 (as would be provided later while referring to FIGS. 2*a* to 4*b* inclusive, it would be elucidated that apparatuses 10 enables to manufacture the two parts of the shroud (in the illustrated example—the nose cone) 15—namely components 35 and 40 as said, as identical and symmetric parts, wherein from the instant of assembling apparatuses 10 they are different one from the other solely from the aspect of their contents (parts of piston assembly 55 that are installed in them and the electricity wiring to it).

The two parts of shroud 15—components 35 and 40 are connected to the head of missile 20 at the base sector 45 through connection means 80.

In the illustrated example, connection means 80 includes an array of connection means 85 (for example—screws that are not illustrated and that connect the head of missile 20 to base sector 45).

Weakening means 90 is formed at the bottom part of nose cone 15 and at a distance from connection means 80 (see the marking L2, labeled 95 in FIG. 1*b*).

In the illustrated example, weakening means 90 is formed as a groove 91. Groove 91 is formed in the wall thickness of the two components 35 and 40 and around their circumference so as to form a ring like outline. On actuating apparatuses 10 and actually executing the separation, groove 91 is intended to serve as a kind of a rotation "axis" for components 35 and 40 that—at the stage of separation, are driven apart one from the other in a revolving movement (see the directions of the arrows 65 and 70 in FIG. 1*c*).

As an alternative to connecting and weakening means 80 and 90, any professional may consider the implementation of a different type of mechanism such as the one described in U.S. Pat. No. 6,679,453 whose title is "Jettisonable Protective Element".

This U.S. Pat. No. 6,679,453 patent, the content of which is incorporated therein by reference, describes the use of a hinge means for connecting a first end of a cover to the aerodynamic body (e.g.—ground to air missile 20 for our purposes). The hinge means is being configured in a manner such that when the cover starts the separation sequence, a force that is exerted on the cover detaches the hinge, thereby removing the cover from the aerodynamic body.

In a specific preferred embodiment, the hinge includes an asymmetric ball element positioned in a suitable socket.

The hinge means may be configured so that the force exerted on the hinge rotates the cover prior to detaching the hinge. In another embodiment, the hinge may be adapted=so that when the second end of the cover separates unto a predetermined angle, the asymmetric ball element is rotated until its disengagement from the socket is achieved, thus effecting spontaneous disassembly of the ball element.

The hinge may be configured so that when the second end of the cover separates, a force exerted on the cover detaches the hinge, thereby removing the cover from the aerodynamic body (e.g.—ground to air missile 20 for our purpose), and the hinge includes a stopper element, serving for limiting the angular movement of the hinge so that when the second end of the cover separates by a predetermined parameter—a force exerted on the cover acts to effect a disengagement of the cover.

This disengagement might include a breaking action of the cover.

The hinge means might include also a shearable pin that the force exerted on the cover might release or break, so as to release the cover from the aerodynamic body (e.g.—ground to air missile 20 for our purpose).

It was found that implementing the suggestion of U.S. Pat. No. 6,679,453 as an alternative to the above described connection and weakening means 80 and 90, might prevent the phenomena of the cover being "closed" again in mid-separation due to high dynamic pressure.

One should understand that in certain applications, a limitation is imposed on the amount of pyrotechnic material allowed to be used (in order to reduce the risk of collateral damage and hindering the homing head due to the explosion). Under such circumstances, one needs to provide the cover with a wide separation angle while still rotating around an "axis" or a "hinge".

In this way, the separating force will be large enough in order to prevent the "re-closing" phenomena and overcome it.

The opening of the cover to a wide angle before a hinge means is broken, as suggested by U.S. Pat. No. 6,679,453, is therefore a preferred solution in applications wherein the combination of connection and weakening means 80 and 90 do not prevent the "re-closing" phenomena.

Let's refer to FIGS. 5*a* to 5*c*. FIGS. 5*a* to 5*c* constitute a sequence of drawings describing an example of a mechanical mechanism 580 made in order to guide a component 535 of a shroud 515 unto a large opening angle before it is detached from ground to air missile 520, and the manner of operation of the mechanism.

Any professional experienced in the field would understand that mechanism 580 may implements the knowledge that was acquired as said from U.S. Pat. No. 6,679,453 and may constitutes an alternate means to the connection and weakening means 80 and 90 (as was described above when referring to the FIGS. a1 to c1).

Mechanism 580 includes a hinge means 503 that is rotatable around axis 506. Hinge means 503 is anchored to component 535 of shroud 515 (or manufactured as an integral part of it). Any professional would understand that an hinge means as said would be dedicated to each one of the two components of the shroud.

Hinge means 503 is formed with weakening slit (groove) 509 parallel to axis 506 and at a distance away from it.

From the instant of the beginning of the splitting of the shroud components (namely activating piston assembly 55, see FIGS. 1*a* to 1*c*), hinge means 503 routes component 535 of shroud 515 unto performing a rotational motion until a large opening angle is formed (see FIG. 5*b*).

Only upon the arrival of hinge means 503 reaches, as said, to such a relatively large enough opening angle, hinge means 503 is hurled (thrown) unto anvil means 512 that is formed at the head of missile 520.

Hurling hinge means 503 unto anvil means 512, causes the breaking (rupture) of hinge means 503 in the area of the weakening slit 509 (see FIG. 5*c*).

Only in this condition, when component 535 of shroud 515 has actually completed its process of said relatively large rotational motion, component 535 is severed away from the head of missile 520.

Any professional would understand that a mechanism 580 as was described above with reference to the accompanying. FIGS. 5*a* to 5*c*, is only one single example for a variety of mechanisms which can be learned from the above mentioned U.S. Pat. No. 6,679,453 and be implemented in an apparatus for splitting and removing of a shroud from an airborne vehicle in accordance with the invention (as a substitute to the connecting and weakening means 80 and 90, as they were described above, when referring to FIGS. 1*a* to 1*c*).

Reference is being made back to FIGS. 1*a* to 1*c*. The separation is triggered by detonating the pyrotechnic charge—a pressure cartridge or a gas generator 60 that constitutes as said, a part of piston assembly 55. Detonating charge 60 causes the activation of piston assembly 55. In its act, piston assembly 55 biases fastening assembly 50 to a stretching stress and as a result, fastening assembly 50 tears up.

In accordance with a constructional characterize feature of the present invention, fastening assembly 50 is located separately and at a distance from piston assembly 55 (see the marking L, labeled 75 in FIG. 1*b*).

From the instant that the tearing of fastening assembly 50 is accomplished as said, piston assembly 55 continues and severs (cuts off) the two parts of nose cone 15 (i. e., components 35 and 40) one from the other.

At this stage, the two parts are driven to an essentially rotary movement (see the directions of the arrows 65 and 70 in FIG. 1*c*) around the base sector 45, wherein weakening groove 91 serves for them as a kind of a rotation "axis". Driving the two components into a motion, as a result from the actuation of piston assembly 55, leads to tearing off and disengagement of base sector 45 from the airborne vehicle, namely missile 20 in the illustrated example, while only a remnant 97 of nose cone 15 is left attached to the missile at the area of connecting means 80.

From the instant of splitting and removing the nose cone type of shroud 15 from missile 20, the optical dome shaped 21 of the sensor that is mounted at the head of missile 20 is exposed. Exposing the optical dome shaped enables, at the next stage, to "acquire" the target, e. g. in the illustrated example—a ground to ground rocket 25, and homing of missile 20 in its direction (see the stage that was labeled 99 in FIG. 1*c*).

The subject of discussion is, as said, solely a sequence of schematic figures of one single example (a ground to air missile 20 that serves for intercepting an enemy's ground to ground rocket), and any professional experienced in this field would understand that an apparatuses in accordance with the invention might also be implemented—similarly, in different airborne vehicles having other designated missions.

Reference is being made to FIGS. 2, 3 and 4 inclusive. FIGS. 2*a* to 2*e* constitute drawings presenting exploded views of various components that are used in apparatuses 10. In FIGS. 3 and 4 inclusive, an apparatus 10 is illustrated wherein it is assembled and safety locked. FIGS. 3*a* and 3*b* present an assembly by cross section view of apparatuses 10 whose components are illustrated in FIGS. 2*a* to 2*e* and show an enlarged view of area marked b-b in drawing 3*a*. FIGS. 4*a* and 4*b*, similarly to FIGS. 3*a* and 3*b*, also constitute a cross section view of an assembly of apparatuses 10 whose components are illustrated in FIGS. 2*a* to 2*e*, but at another angle (a cross section at 90 degrees angle rotation relative to the cross section illustrated in FIG. 3*a*) and an enlarged view of the area marked b-b in drawing 4*a*.

Let's first revert to FIGS. 2*a* and 2*b*. Note that in FIGS. 2*a* and 2*b*, components 35 and 40 are illustrated by a front view and by a sidewise cross section (marked b-b in FIG. 2*a*), respectively, and shown with local enlargements at places of interest in order to increase clearness.

Any experienced professional would understand that the subject of discussion is actually symmetric and identical components. In other words, a preferred embodiment of an apparatus in accordance with the invention (apparatus 10 shown as an example only in the attached drawings), may implements an additional optional characteristic feature of the invention—namely the feasibility of manufacturing the two elements of shroud 15, namely components 35 and 40, as symmetric and identical components (while gaining in addition to savings of their production costs—also expending reduced efforts and time).

Each of the two components 35 and 40 is formed with a first bracket means 212 that is adapted to embrace and include in it the fastening assembly 50 (see FIG. 3*b*), and with a second bracket means 214 that is located at a distance and separated from the first bracket means 212 (see the marking L, labeled 75 in FIGS. 2*a* and 2*b*), suited to embrace and include in it the piston assembly 55 (see FIG. 3*b*).

Attention should be given to the local enlargements in the figures—

First bracket means 212 is formed as a bore 216 with an external shoulder 218 and with an internal shoulder 220. Opening 222 enables access to external shoulder 218 from the outer side of the shroud component.

Internal shoulder 220 is formed at the end of a space 224. Space 224 is formed with an opening 226 that connects space 224 with an opening 226 that connects between space 224 to second bracket means 214.

Second bracket means 214 is formed as a space 228 that is closed at its end that faces the external side of the shroud component and open at its other end that faces the internal side of the shroud component.

At its closed end space 228 is formed as a dome with a releasing space 229 at its center. At its open end, space 228 is formed with a circumferential bracket 230. Slot 232 is formed along the length of space 228 and is suited in its dimensions to hold the pyrotechnic charge 60 (see FIG. 3*b*).

In the illustrated example, added thickness was set on bracket 214 and around its circumference, because on its surface the shock type of impact, produce by the action of piston assembly 55, is applied (following the timed detonation of pyrotechnic charge 60). in the illustrated example, the thickening was performed while trying to reduce superfluous weight by forming a circumferential array of strengthening ribs 234.

Any professional experienced in this field would understand that because a constructional characteristic of the invention is that the operation axes 36 and 41 of the two assemblies—fastening assembly 50 and piston assembly 55 are essentially parallel one to the other and radial and orthogonal in their direction in relation to the lengthwise axis 16 of the shroud, then in the illustrated example, also brackets means 212 and 214, are formed in the same directions (essentially parallel to each other and radial and orthogonal in their direction in relation to the lengthwise axis 16).

The two components 35 and 40 are amenable to be manufactured by an injection process (into molds), machining, or by a combination of the two and in a large variety of materials. For example, the components might be made of a polymeric resin that was selected from the group of materials produced by the General Electric Company, known in their commercial brand name ULTEM (dosed with fiberglass at 10 to 30% concentration), from other polymeric materials or from metal—for example aluminum.

The two components 35 and 40 are formed in an identical shape, as said, with sectors of groove 91 that in accordance with the illustrated example and as was described above when referring to the FIGS. 1*a* to 1*c*, constitute weakening means 90 (the means around whose circumference there occurs the tearing off and the plucking of the shroud from the airborne vehicle body).

The two components 35 and 40 are formed in an identical shape, also as per having an identical array of openings 236 that in accordance with the illustrated example and as has already been described above when referring to FIGS. 1*a* to 1*c*, are suited to receive inside them the screws that serve to attach the shroud to the airborne vehicle body.

Moreover, the two components 35 and 40 are also formed in an identical shape as it applies to the array of strengthening ribs 238 and threaded brackets 240 that are formed in the two components.

In regards to additional constructional aspects of components 35 and 40, see below—it will be described and elaborated upon when referring to the other figures.

Let's refer now to FIG. 2*c*, wherein the components of fastening assembly 50 that is amenable to be torn by stretching are illustrated. Fastening assembly 50 comprises a component 242 that, as said, can be torn by stretching. Component 242 is suited to mounting a stretching means 244 on its one end, and a shoulder means 246 on its other (second) end. Component 242 that can be torn by stretching, is formed with a weakening sector 248 in its center and include in addition, a rotation preventing means 250.

As said, and as can be observed in FIG. 3*b*, fastening assembly 50 is suited to be installed in first bracket means 212 that is formed in the two components—35 and 40.

In the illustrated example, stretching means 244 and shoulder means 246 are just two screws (in the illustrated example—standard Allen type of screws), that are suited for installation—each of them, at the opposite end of the tearable on stretching component 242 (at matching threaded brackets that are formed in component 242).

Upon installation (and see FIG. 3*b*), the screw heads are leaning, each of them, on shoulders 218 that are found in the relevant components (35 or 40). Opening 222 enables easy access from the outside to the two screws' heads for tightening it while utilizing a rather standard work tool (in accordance with the illustrated example—an Allen wrench).

The tearable on stretching component 242 includes as said, a rotation preventing means 250. Any experienced professional would understand that in the course of the process of fastening components 35 and 40 one to the other, if the rotation of component 242 around itself (see FIG. 3*b*—around axis 36), would be prevented, then the tightening would expose the component to stresses that are essentially pure stretching stresses. Thus it is feasible to achieve optimization of the splitting and removing process while neutralizing influence of variables in the form of other and different stresses (torsion stresses) that otherwise might be induced in the tearable on stretching component 242.

In the illustrated example, the rotation preventing means 250 are just two headless Allen screws that are suited for installation, each one of them, so that they would protrude outwards from component 242 (and mounted in it at matching brackets threads formed in component 242).

The illustrated example demonstrates to what extent might fastening assembly 50 is assembled, essentially, just by standard production components, and only does the tearable on stretching component 242 requires individual machining type of manufacturing (for example made from SAE 4340 steel). Any experienced professional would understand that similar fastening assembly might be assembled from other different and varying materials, for example, the rotation preventing means 250 might be formed as an integral part that protrudes from the tearable on stretching component 242, or that forming the component proper in a cross section that is not round (while suiting bore 216 to this cross section), might constitute that one rotation preventing means.

Let's refer now to FIG. 2*d*, wherein there are illustrated inter alia the components of the piston assembly 55 that is disassembled (disintegrate) on conclusion (termination) of the piston's stroke. Piston assembly 55 comprises two houses components—first house component 255 and second house component 257 (whose shape resembles two halves of an egg).

Houses 255 and 257 are formed, each of them, with its internal space, 259 and 261, respectively, open at its one end and closed at the other.

Houses 255 and 257 are suited for being installed, one facing the other, one internal space 259 opposite its second—261 (see FIG. 3*b*). Any professional would understand that installing the houses as said—one opposite the other, actually bounds and defines the cylindrical space in which the piston would operate. In the illustrated example, the installation of the houses is performed by interlacing an end of house 255 in bracket 263 that is formed at the end of house 257.

In the illustrated example, each of houses 255 and 257 is formed with shoulders that protrude from their circumference—265 and 267, respectively.

As was pointed out above when referring to FIGS. 2*a* and 2*b*, brackets means 214 are formed, each one, with a circumferential bracket 230 that is formed around the open end of space 228. Circumferential brackets 230 are suited in their dimensions to embrace and include in them the protruding shoulders 265 and 267. In addition, houses 255 and 257 are formed as said, as the likeness of halves of an egg, an end of each of the houses is formed in a radius that is essentially identical to the radius of the one formed at the closed dome like end of space 228 in which the house component is included (see FIG. 3*b*).

Any professional would understand that leaning piston assembly 55 on components 35 and 40, while relying on the structure of shoulders protruding from the houses components, wherein piston assembly 55 is supported by the circumferential brackets that were formed on the edges of the bracket means (and not on the closed ends of the spaces that are formed in the bracket means), contribute to ensuring elastic pressing of components 35 and 40.

This elastic pressing is provided both—at the stage of fastening components 35 and 40 one to the other by applying fastening assembly 50 as well as at the stage of actuating the piston. Positioning piston assembly 55 on the circumferential brackets formed at the edges of the bracket means, ensures that the strike of the piston action would pass over—first from all, to the strengthening ribs formed in components 35 and 40, and would not cause local biasing at the bottom of the bracket space (and therefore, contribute for avoiding the risk of forming a fracture at the bottom of the bracket).

The two halves of the egg, in other words—houses 255 and 257, might be made of PH type of stainless steel that enables a machining run following the thermal treatment of the components and does not harmed by a significant distortion resulting from the thermal treatment.

Any professional would appreciate the fact, that the discussed subject refers to small and relatively compact metal made components, wherein the structure of brackets 212 and 214 in the illustrated example might be based on polymeric materials. This fact eventually contributes to reducing the weight of the apparatus.

Piston assembly 55 includes in addition, a Piston rod 269. Piston's rod 269 is adapted to being assembled inside the cylindrical space that is defined and bounded from the instant of installing the houses components 255 and 257 one to the other (the internal spaces 259 and 261). Piston's rod 269 is movable inside the houses components, for pushing the closed end of the second house component 257, that in other words—serves as an anvil upon which then piston's rod 269 impinges on detonation of pyrotechnic charge 60 (see FIG. 3*b*).

Piston's rod 269 might be manufactured from steel (for example—SAE 4340).

An additional device that is part of piston assembly 55 is a pyrotechnic charge 60 that is a pressure cartridge or a gas generator that can be electrically triggered. Pyrotechnic charge 60 is connectable to the one end of first house component 255. As said, pyrotechnic charge 60 serves—upon its electrical actuation and subsequently detonation, to drive piston's rod 269 towards the closed end of second house component 257 that, as said, serves as an anvil for it, and from the other side, the gas pressure generated by the detonation of pyrotechnic charge 60 serves for pushing first house component 255 and moving it away from piston's rod 269.

Pyrotechnic charge 60 might be a pressure cartridge or a standard gas generator that was selected from a group of commercially available products that include products known by their brand names as RAFAEL 55914 and RAFAEL 54753.

In the illustrated embodiment, pyrotechnic charge 60 is composed of assembly 271 that is formed with a thread and tightening nut at its one end, and with an electricity connection on its other end, and with a sealing component 272. Assembly 271 is adapted to be installed in a threaded bore 273 (see FIG. 3*b*) that is formed at the flank of first house component 255. The flank of house 255 constitutes a base for seal 272 unto which assembly 271 is fastened. On mounting of piston assembly 55 in the apparatus (see FIG. 3*b*), pyrotechnic charge 60 is positioned at slot 232 that is formed along bracket means 214. Passage means 276 that, in the illustrated example is formed as a bore at the closed end of first house component 255, is gas flow communicate with threaded bore 273. On detonation of pyrotechnic charge 60, the gas flow that is created is led through passage means 276 towards expansion chamber 278, that upon installing piston assembly 55 (see FIG. 3*b*), is defined between the piston's rod 269 and the closed end of space 259.

Expansion chamber 278 sealing is kept by annular (O-ring shaped) gasket 280 that is adapted to be mounted inside groove 281 that is formed on the circumference of piston rod 269. In addition, applying a vacuum durable type of grease on the gasket may contribute for the sealing performance and even provide durability of the assembly against corrosion.

In the illustrated example, piston assembly 55 that is disassembled on conclusion of the piston's stroke, includes in addition, anchoring means 282. Anchoring means 282 anchors the piston's rod 269 to second house component 257. The anchoring is accomplished in a manner that enables, as said, movement of rod 269 towards the closed end of second house component 257 that—as said, serves as an anvil for it, but simultaneously—the anchoring enables also angular movement of rod 269 from the instant that the two houses 255 and 257 are separating and moving away one from the other.

In the illustrated embodiment, anchoring means 282 is realized by springy pin (for example—a (letter) C shaped type of a springy pin). Springy pin 282 is affixed to second house component 257, by matching bores 284 formed at the wall of house 257. On installing piston assembly 55 (see FIG. 3*b*), springy pin 282 is affixed to the second house component 257, while it passes through opening 285 that is formed in the piston's rod 269. The dimension of opening 285 is larger than that of springy pin 282 and hence enables linear and angular movements of the piston's rod 269 relative to second house component 257 and inside inner space 261 that is formed in it.

The enablement of angular movements of rod 269 exists following the detonation of the pyrotechnic charge and is based on forming the piston's rod with a "neck" sector 288 that is relatively thin. The "neck" sector 288 remains located at the opening of space 259 that is formed in first house 255, and even after the piston's rod hit the "anvil"—the closed end of second house component 257. In this manner, the piston's rod component remains harnessed to second house component 257 that it hit on detonation of the pyrotechnic charge, as on an "anvil", but simultaneously, at this stage, angular movement is allowed to the piston's rod, while components 35 and 40 are getting separated and moving away one from the other, while in each one of them there is pinned the house component that hit it (see FIG. 3*b*).

Any professional experienced in this field would appreciate the fact that this configuration that enables "wobbling" of the piston's rod in the course of the splitting and removing process, contributes to preventing the clamping phenomena from evolving and reduce the risk of seizure of the piston's rod inside first house component 255. This configuration also ensures that the piston's rod would not be separated from the second house component 257, that upon detonation of the pyrotechnic charge, is stricken by the head of the piston's rod and strongly embedded deep into bracket 214 in which it was located.

Let's continue with the illustrated example while referring to FIGS. 2*d*, 4*a* and 4*b*. Apparatus 10 for splitting and removing nose cone 15 from missile 20 includes in addition, safety means 288.

Safety means 288 is an extractable "before launch" type of safety-catch. As long as it was not extracted nor taken out from its place, it prevents the separation (getting away one from the other) of components 35 and 40, even in case the pyrotechnic charge was activated inadvertently or due to a failure.

In accordance with the illustrated example, safety means 288 includes safety lock component 290, extractable security pin 291 that is suited to be installed in bore 292 that is formed at one end of safety lock 290 (in the illustrated example pin 291 is a springy pin), and a handle component 293 that is suited to be installed in bore 294 formed at the other end of safety lock component 290 (in the illustrated example the handle component is a (letter) C-shaped type of a springy pin).

Safety lock component 290 links together the two house components (255 and 257, respectively) with the piston's rod 269 (see FIG. 4*b*). In the illustrated embodiment, the linking one to the other of the two house components (255 and 257) and the piston's rod, is accomplished by installing safety lock component 290 inside bore 296 that is formed in second house component 257, and also within bore 297 formed in first house component 255 and within bore 299 that is formed in piston's rod 269. Components 35 and 40, formed in their edges with matching openings 301 (see FIGS. 2*a* and 2*b*) that enable threading of safety lock component 290. Safety lock component 290 is secured against random or inadvertent extraction through the mounting of springy pin 291.

Any professional would understand that in this configuration it is possible to design safety lock component 290 with the adequate thickness and strength, so that the safety lock would withstand the shearing stresses to which it will be exposed in case that the pyrotechnic charge 60 would be activated inadvertently or due to a failure. The durability of component 290 would prevent sever environmental damage and safety hazardous that otherwise might have been caused as a result of splitting and removing of the shroud due to the detonation of the pyrotechnic charge inadvertently or due to a failure.

In accordance with the illustrated example of the invention, safety lock component 290 is extractable as said, by a perpendicular movement relative to the lengthwise axis 16 of the shroud (see FIGS. 4*a* and 4*b*). Any professional would understand that in this manner, it is feasible to include missile 20 into a launcher (e. g. the so called "missile in a box" type), wherein a mechanical safety lock secures the devise all the time (not only the electrical safety precaution as is common). In such a configuration, extracting the safety lock is conducted at a relatively safe timing—when the missile is already inside the canister that provides defense from the otherwise flying nose cone in case of failure or inadvertent detonation of the pyrotechnic charge.

Reference is being made to FIG. 2*e*. In the illustrated example, apparatus 10 includes in addition, two means 305 and 307, for supplementing its aerodynamic configuration. Means 305 and 307 are adapted to be installed one facing the other, between components 35 and 40 (see FIGS. 3 and 4 inclusive).

In accordance with the illustrated example (see FIG. 1*c*), from the instant of splitting shroud 15, supplementing means 305 and 307, prevent the formation of air turbulence inside components 35 and 40, turbulence that could have disrupted the moving away one from the other of these two components (or driving one of them to hit the missile's body).

Any professional would understand that we are considering optional means, and that it is feasible just as well to ensure prevention of unwanted impact as said, by other means such as accurate and careful aerodynamic design of components 35 and 40 and of the array of strengthening ribs 238 that are formed in components 35 and 40, an array that from the instant of splitting and removing of the two components one from the other, is exposed like ailerons to the influence of the air flow.

In the illustrated example, the supplemental aerodynamics means 305 and 307, are identical components one to the other, that are formed like flat surfaces and are suited to be mounted on strengthening ribs 238 (see FIGS. 2*a* and 2*b*). Installing means 305 and 307 is accomplished using catching means 309 that are formed on the one side of means 305 and 307 suited to embrace strengthening ribs 238, and in addition, by using a set of screws (that are not illustrated) which are suited to be installed in an array of openings 311 that are formed in the flat surface of means 305 and 307 and given to be threaded in the array of threaded brackets 240 (see FIGS. 2*a* and 2*b*). means 305 and 307 are formed, each one of them, with an opening 313 that is suited by its dimensions to enable free passage of fastening assembly 50 and piston assembly 55. means 305 and 307 are formed, each one of them, also with a transverse dent 315, suited by its dimensions for the positioning in it of the rotation preventing means 250, and to the passing of safety lock component 290 (see FIG. 2*b*). Means 305 and 307 might be manufacture from the same material that serves for the manufacture of the shroud's components 35 and 40.

The nose cone type of shroud 15 that is illustrated in the accompanying figures, includes in addition, wiring means (not illustrated) that electrically connects assembly 271 of pyrotechnic charge 60 to base sector 45 of the shroud and moreover—an electrical contact means that electrically connects the wiring means to missile 20 (from which the timed command to detonate the pyrotechnic charge is sent).

Any professional would understand that the wiring means might be an electrical wiring cable that is ordered as an integral part of assembly 271 (of pyrotechnic charge 60). The electrical contact means (that can be cut off upon splitting and removal of the shroud—not illustrated) might be an assemblage of springy leaf shaped contacts that are located in dents 320 shown as formed in the two symmetric components 35 and 40 (see FIGS. 1*a*, 2*a* and 4*a*), and suited to connect to an array of counter-springy contacts (not illustrated) that are installed at the head of missile 20.

Any professional would understand as well that other types of wiring means and electrical contact means (amenable as said, to be cut off upon separation), might be implemented in an apparatus in accordance with the invention (for example—detachable wiring that can be removed from the pyrotechnic charge, a detachable connector of electrical pins and so on).

In view of the above given description, while referring to the accompanying figures, any professional would appreciate that in view of the operation mode of apparatus 10, there is also embodied a general method, that might be implemented whenever professionals are required to provide adequate solutions for tasks of splitting and removing a shroud from the body of an airborne vehicle.

The method includes the stage of the pyrotechnic activation of a piston assembly that is disassembled upon completing of the piston's stroke (in the illustrated example—piston assembly 55). The piston assembly is positioned at a distance (see mark L labeled 75 in FIG. 1*b*), and separately from a fastening assembly that serves to fasten two shroud components one to the other (fastening assembly 50 in the illustrated example). The piston assembly, by its timed operation, biases the fastening assembly to a stretching stress that brings about it tearing (in the illustrated example—a tearing that occurs in weakening sector 248). The actuating axes of the two assemblies (in the illustrated example—axes 41 and 36), are essentially parallel one to the other and essentially orthogonal and radial in their direction of operation relative to the lengthwise axis of the shroud (axis 16 in the illustrated example).

Any professional would understand as well that the method might also include preliminary stages of enclosing the airborne vehicle into a canister while an extractable safety means (in the illustrated example—safety means 288) prevents separation one from the other of the two shroud components even in cases wherein the pyrotechnic charge was inadvertently or due to a failure detonated. It also might include an additional preliminary step of extracting the safety means before launching of the airborne vehicle.

In view of the description given above, while referring to the accompanying figures, any professional would appreciate that apparatus 10, as well as other devices that are essentially similar to this one and that implement the principles of the present invention as it was described above solely by way of presenting an example and while referring to the accompanying figures, is a novel and advanced apparatus for splitting and removing a shroud from the body of an airborne vehicle, that overcomes the drawbacks and deficiencies that as said, were found to exist in the prior art relevant to the present invention—

In contra distinction to the knowledge prevailing in the prior art, apparatus 10 is durable from the aspect of imperviousness (sealing up) and escape of gases, since the construction of piston assembly 55 does not rely on threaded connectors but rather employs a structure of two houses interlaced one in the other (in the illustrated example—first house component 255 and second house 257).

Severing the aerodynamic continuum in apparatus 10 is minimal—openings 222 are required only in order to enable access of a screw's key (wrench) through them (in the in the illustrated example—an Allen wrench). Even in the configuration wherein there is an apparatus equipped with an extractable safety means, enabling passage of the safety lock component 290 only minimal site of openings 301 are required, which are relatively small in their dimensions.

The clamping risk of parts being caught one in another, is not an issue in apparatus 10, and this because—in accordance with the invention, use is made of a piston assembly 55 that disintegrates at the end of the piston stroke, and not of cylindrical components that might be caught one in the other.

In addition, in a preferred embodiment of the invention, the piston's rod is provided with angular motion capabilities that also contribute to the minimal risk of clamping upon separation.

apparatus 10 might also be manufactured in relatively low costs, and this due to the possible symmetry of its two major parts (components 35 and 40 in the illustrated example as well as in the construction of means 305 and 307), helped by the small number of components and their relative simplicity.

Finally, apparatus 10 might also include a reliable mechanical safety lock for the pyrotechnic charge (as is described in the illustrated configuration, namely safety lock component 290).

While overcoming the deficiencies that are embodied in the described prior art, in view of the description divulged above while referring to the accompanying figures, any professional would appreciate that apparatus 10 and devices similar to it that also implemented the principles of this invention, might be designed so that the stability of the shroud is not impaired until issuing the split and remove command.

Activating piston assembly 55 and therefore causing the tearing of fastening assembly 50 (as it occurred in the weakening sector 248 of the tearable on stretching component 242), might materialize without impairing the integrity of components 35 and 40, and they are given to be separated and move apart one from the other, as a whole and without producing fragmentation, splinters nor fracture (except in the designed area for it, i. e.—weakening groove 91).

The separation stage might be planned as an intensive act, sufficiently active in a manner that it prevents impinging of the shroud or other components on the airborne vehicle body.

Apparatus 10 is given to operate efficiently in any envelope of performance that a relevant airborne vehicle body is subjected to (in terms of parameters such as velocity, angles of attack and accelerations). Similar apparatuses under the same operational conditions would provide similar results (i. e., maintain repeatability).

Apparatus 10 in accordance with the invention, might be designed so that it would withstand accepted environmental conditions that are valid for any airborne vehicle of the relevant type (for example—ground to air missile 20), and as stressed again—apparatus 10 has relatively light weight and can be manufactured in series production and Any professional would understand that the present invention was described above solely in a way of presenting examples, serving our descriptive needs and those changes or variants in the structure of the apparatus for splitting and removing of a shroud from an airborne vehicle and its method of construction and operation—the subject matter of the present invention, would not exclude them from the framework of the invention.

In other words, it is feasible to implement the invention as it was described above while referring to the accompanying figures, also with introducing changes and additions that would not depart from the constructional and operational steps, characteristics of the invention, characteristics that are claimed herein under.

The invention claimed is:

1. An apparatus for splitting and removing a shroud from an airborne vehicle, the apparatus comprising:

a shroud that includes two components, longitudinally linkable one to another, and wherein upon being fastened one to the other, form said shroud with a lengthwise axis and an inner space, and having a base sector around a circumference of a bottom part of said shroud, and wherein said base sector is connectable to said airborne vehicle; and a fastening assembly for fastening said two components of said shroud one to the other, and wherein said fastening assembly is configured to be torn by stretching along a first axis of operation upon detonation of a pyrotechnic charge; and a piston assembly comprising a piston element operable by said pyrotechnic charge for providing a piston stroke along a second axis of operation and wherein said piston assembly is configured to disassemble upon completion of said piston stroke, and is configured for timed tearing of said fastening assembly and active removal of said two components of said shroud one from the other, in an essentially revolving motion and while tearing and moving farther apart said shroud from said airborne vehicle; and wherein said apparatus is characterized by— said fastening assembly configured, upon detonation of said pyrotechnic charge, to be torn on stretching and positioned at a distance and separated from said piston assembly; and by the first axis of said fastening assembly that is torn on stretching, and the second axis of said piston assembly that is disassembled upon termination of the piston stroke, wherein the first axis and the second axis are essentially parallel one to the other, while essentially in an orthogonal and radial direction of operation relative to said shroud's lengthwise axis.

2. An apparatus for splitting and removing a shroud from an airborne vehicle in accordance with claim 1, wherein said two components of said shroud are identical and wherein each one of said components is formed, with— a first bracket formed as a bore with a shoulder and an opening that enables access to said shoulder from an external side of said shroud and wherein said first bracket is suited to embrace said fastening assembly made to be torn on stretching; and a second bracket formed as a space that is closed at its end that faces the external side of said shroud, and with a slot along its length that is suited in its dimensions to hold said pyrotechnic charge and wherein said second bracket is positioned at a distance and separate from said first bracket, and suited to include said piston assembly that disassembled upon completion of the said piston stroke.

3. An apparatus for splitting and removing a shroud from an airborne vehicle in accordance with claim 1, wherein said two components of said shroud, are made from a polymeric material.

4. An apparatus for splitting and removing a shroud from an airborne vehicle in accordance with claim 1, wherein said base comprises— weakening means formed around a circumference of said base; and connection means for connecting said shroud to said airborne vehicle that is located at a lower part and at a distance from said weakening means.

5. An apparatus for splitting and removing a shroud from an airborne vehicle in accordance with claim 4, wherein said weakening means are grooves formed in the wall thickness of said two components and around a circumference of each said two components so as to form a ring like outline.

6. An apparatus for splitting and removing a shroud from an airborne vehicle in accordance with claim 5, wherein said connection means for attaching said shroud to said airborne vehicle, includes an array of openings formed in said two components around said circumferences of each of said two components and suited to receive connecting means that are connectable to said airborne vehicle.

7. An apparatus for splitting and removing a shroud from an airborne vehicle in accordance with claim 1, wherein said base includes— a hinge for connecting said base sector of said component of said shroud to said airborne vehicle, and wherein said hinge being configured that when said component starts to separate, a force exerted on said component of said shroud detaches said hinge, thereby removing said component from said airborne vehicle.

8. An apparatus for splitting and removing a shroud from an airborne vehicle in accordance with claim 7, wherein said hinge being configured so that said force exerted on said hinge rotates said component of said shroud prior to detaching said hinge.

9. An apparatus for splitting and removing a shroud from an airborne vehicle in accordance with claim 7, wherein said hinge is formed with a weakening slit and an anvil means; and is adapted so that when said component of said shroud separates to a predetermined angle, said hinge is rotated until striking said anvil means which cause said hinge means breakage along said weakening slit.

10. An apparatus for splitting and removing a shroud from an airborne vehicle in accordance with claim 1, wherein said fastening assembly includes— a component that is given to be torn on stretching; and a stretching means that is suited to be installed at a one end of said component that can be torn on stretching; and a shoulder means that is suited to be installed at said second end of said component that can be torn on stretching, and wherein said component that can be torn on stretching is formed with a weakening sector; and it is suited to be installed inside brackets that are formed in said two components of said shroud.

11. An apparatus for splitting and removing a shroud from an airborne vehicle in accordance with claim 10, wherein said fastening assembly given to be torn on stretching includes also a rotation preventing means meant to prevent biasing of said component that is given to be torn on stretching to torsion stresses when fastening said two components of said shroud and linking said two components of said shroud one to another.

12. An apparatus for splitting and removing a shroud from an airborne vehicle in accordance with claim 10 wherein said stretching means and said shoulder means constitute two screws that are each installed from said opposite end of said component that is given to be torn on stretching, wherein at least one head protrudes from a circumference of said stretching means.

13. An apparatus for splitting and removing a shroud from an airborne vehicle in accordance with claim 1, wherein said piston assembly that disassembled upon completion of the piston stroke, comprises— a first and second house components each formed with an open inner space at a first house component end and closed on a second house component end, and are suited to be installed one against another, one inner space facing an opposite secondary inner space; and a piston rod component suited to be installed inside said inner spaces and is movable in said inner spaces in order to push said closed inner end of said second house component that serves as an anvil; and an electrically detonable pressure cartridge or a gas generator that upon actuation serves as said pyrotechnic charge and that is connectable to said closed inner end of said first house component for driving said piston rod component, to move towards said closed end of said second house component that—as said, serves as an anvil to said rod and simultaneously to drive said first house component in a direction opposite to the movement direction of said piston rod component.

14. An apparatus for splitting and removing a shroud from an airborne vehicle in accordance with claim 13, wherein said piston rod is formed with a neck sector that is thin, and wherein said a piston assembly further comprises:

anchoring means that anchors said piston rod unto said second house component in a manner that— it enables movement of said piston rod towards said closed end of said second house component that—as said, serves as an anvil to said rod; and enables angular movement of said piston rod from the beginning of the separation of said first house component from said second house component.

15. An apparatus for splitting and removing a shroud from an airborne vehicle in accordance with claim 14, wherein said anchoring means is a springy pin that is affixed unto said second house component and able to pass through an opening that is formed in said piston rod component, and wherein said opening enables by its dimensions linear and angular movements of said piston rod relative to said second house component and within its inner space.

16. An apparatus for splitting and removing a shroud from an airborne vehicle in accordance with claim 1, wherein said apparatus further comprises:

an extractable safety means that as long as it was not extracted and removed from its position, it prevents said two components of said shroud to separate and move farther apart one from the other, even in case wherein said pyrotechnic charge has been detonated inadvertently or due to a failure.

17. An apparatus for splitting and removing a shroud from an airborne vehicle in accordance with claim 16, wherein said safety means includes safety lock that connects together said piston assembly and is extractable by a sideways movement relative to said length axis of said shroud.

18. An apparatus for splitting and removing a shroud from an airborne vehicle in accordance with claim 1, wherein said shroud further comprises two means for supplementing said shroud aerodynamic configuration upon said splitting and during said removing, that are suited to be installed one opposite to another between said two components of said shroud.

19. An apparatus for splitting and removing a shroud from an airborne vehicle in accordance with claim 1, wherein said shroud further comprises:

wiring means for electrically connecting said the pyrotechnic charge to said base; and an electrical contact means positioned at said base and electrically connects between said pyrotechnic charge and said airborne vehicle in a detachable upon said shroud separation and removing manner.

20. A method for splitting and removing a shroud from an airborne vehicle, the method comprising:

pyrotechnically actuating a piston assembly that is disassembled upon completing the piston stroke, and that is positioned at a distance and separated from a fastening assembly that serves for fastening the two shroud's components one to the other, and wherein the piston rod movement causes the biasing of said fastening assembly into a stretching stress that brings about its tearing, and wherein the first axis and the second axis are essentially parallel one to the other, and essentially in an orthogonal and radial direction of operation relatively to the lengthwise axis of said shroud.

21. A ground to air missile in which there is installed an apparatus for splitting and removing a shroud in accordance with claim 1.

22. A method for splitting and removing a shroud from an airborne vehicle in accordance with claim 20, wherein the method further comprises:

enclosing said airborne vehicle into a canister while an extractable safety means prevents separation one from the other of the two shroud components even in cases wherein the pyrotechnic charge was inadvertently or due to a failure detonated; and extracting said safety means before launching of said airborne vehicle.

* * * * *